US008991962B2

(12) United States Patent
Gerrits

(10) Patent No.: US 8,991,962 B2
(45) Date of Patent: Mar. 31, 2015

(54) INK JET PRINTING METHOD AND PRINTER

(71) Applicant: OCE-Technologies B.V., Venlo (NL)

(72) Inventor: Carolus E.P. Gerrits, Velden (NL)

(73) Assignee: OCE_Technologies B.V., Venlo (NL)

( * ) Notice: Subject to any disclaimer, the term of this patent is extended or adjusted under 35 U.S.C. 154(b) by 0 days.

(21) Appl. No.: 14/189,738

(22) Filed: Feb. 25, 2014

(65) Prior Publication Data

US 2014/0176633 A1 Jun. 26, 2014

Related U.S. Application Data

(63) Continuation of application No. PCT/EP2012/065934, filed on Aug. 15, 2012.

(30) Foreign Application Priority Data

Aug. 26, 2011 (EP) ..... 11178981

(51) Int. Cl.

| | |
|---|---|
| ***B41J 2/205*** | (2006.01) |
| ***B41J 2/07*** | (2006.01) |
| ***B41J 2/21*** | (2006.01) |
| ***B41J 29/393*** | (2006.01) |

(52) U.S. Cl.

CPC *B41J 2/07* (2013.01); *B41J 2/2142* (2013.01); *B41J 29/393* (2013.01)

USPC ..... 347/15

(58) Field of Classification Search

None

See application file for complete search history.

(56) References Cited

U.S. PATENT DOCUMENTS

| | | | | |
|---|---|---|---|---|
| 7,393,077 | B2 | 7/2008 | Kusakari | |
| 2006/0274112 | A1 | 12/2006 | Jackson Pulver et al. | |
| 2007/0171247 | A1 * | 7/2007 | Kitagawa | 347/15 |
| 2010/0091053 | A1 | 4/2010 | Jackson et al. | |

FOREIGN PATENT DOCUMENTS

| | | | |
|---|---|---|---|
| DE | 10 2007 035 805 | A1 | 2/2009 |
| WO | WO 2007/114527 | A1 | 10/2007 |

* cited by examiner

*Primary Examiner* — Geoffrey Mruk
*Assistant Examiner* — Bradley Thies
(74) *Attorney, Agent, or Firm* — Birch, Stewart, Kolasch & Birch, LLP

(57) ABSTRACT

A method of printing a spit pattern for an inkjet printer includes selecting a dot distance between dots of the spit pattern, selecting at least a sub-matrix of a dither matrix of entries arranged in rows and columns, constructing a bi-level bitmap of the same size as the sub-matrix, splitting each column of the bi-level bitmap which has more than one entry having a value of one into a number of columns such that each column of the number of columns comprises one entry having a value of one, removing each column of the bi-level bitmap which has no entry having a value of one, extracting the row and column number of each entry of the bi-level bitmap having a value of one, adapting the row number of each extracted entry in accordance with the dot distance, and printing the spit pattern.

10 Claims, 15 Drawing Sheets

DM

| | | | | | | | | | | | | | | | | |
|---|---|---|---|---|---|---|---|---|---|---|---|---|---|---|---|---|
| 163 | 120 | 8 | 235 | 129 | 35 | 249 | 123 | 167 | 78 | 245 | 97 | 127 | 2 | 110 | 216 | . . . . |
| 65 | 220 | 199 | 60 | 86 | 181 | 104 | 57 | 228 | 14 | 186 | 203 | 34 | 236 | 190 | 151 | |
| 20 | 105 | 41 | 155 | 212 | 16 | 162 | 206 | 91 | 149 | 117 | 59 | 138 | 84 | 53 | 21 | |
| 80 | 171 | 252 | 72 | 115 | 240 | 30 | 137 | 43 | 214 | 25 | 241 | 175 | 211 | 161 | 224 | |
| 229 | 139 | 3 | 187 | 134 | 51 | 196 | 81 | 256 | 169 | 73 | 100 | 10 | 113 | 37 | 121 | |
| 46 | 95 | 209 | 36 | 89 | 222 | 159 | 111 | 6 | 126 | 192 | 153 | 230 | 69 | 253 | 200 | |
| 202 | 160 | 116 | 242 | 177 | 13 | 68 | 183 | 215 | 63 | 31 | 207 | 47 | 179 | 146 | 92 | |
| 246 | 15 | 76 | 56 | 145 | 232 | 101 | 45 | 142 | 227 | 108 | 136 | 85 | 19 | 125 | 54 | |
| 135 | 184 | 217 | 168 | 26 | 122 | 205 | 250 | 18 | 173 | 75 | 247 | 166 | 219 | 185 | 243 | |
| 49 | 33 | 102 | 130 | 195 | 79 | 38 | 158 | 88 | 55 | 197 | 1 | 39 | 103 | 64 | 9 | |
| 198 | 234 | 67 | 255 | 5 | 225 | 114 | 189 | 128 | 237 | 150 | 119 | 226 | 157 | 213 | 140 | |
| 106 | 143 | 22 | 156 | 94 | 178 | 61 | 11 | 208 | 28 | 98 | 50 | 188 | 77 | 29 | 93 | |
| 176 | 87 | 191 | 210 | 48 | 133 | 244 | 165 | 70 | 218 | 180 | 239 | 17 | 132 | 231 | 52 | |
| 223 | 42 | 74 | 118 | 221 | 32 | 82 | 141 | 107 | 44 | 124 | 83 | 164 | 204 | 109 | 172 | |
| 112 | 251 | 170 | 12 | 147 | 182 | 233 | 23 | 201 | 248 | 7 | 144 | 62 | 254 | 40 | 4 | |
| 148 | 27 | 131 | 238 | 66 | 96 | 193 | 58 | 154 | 90 | 174 | 194 | 24 | 99 | 152 | 71 | |
| 47 | 98 | 196 | 51 | 209 | 112 | 4 | 125 | 228 | 36 | 69 | 235 | 116 | 212 | 182 | 237 | |
| 168 | 241 | 77 | 156 | 21 | 174 | 255 | 76 | 167 | 109 | 208 | 133 | 49 | 80 | 12 | 129 | |
| 140 | 8 | 119 | 219 | 86 | 138 | 45 | 211 | 142 | 9 | 180 | 29 | 161 | 244 | 145 | 223 | |
| 204 | 61 | 184 | 37 | 234 | 201 | 100 | 25 | 221 | 62 | 249 | 97 | 200 | 58 | 101 | 22 | |
| 85 | 250 | 108 | 152 | 15 | 67 | 148 | 190 | 88 | 118 | 154 | 74 | 2 | 215 | 166 | 121 | |
| 4 | 130 | 46 | 175 | 246 | 120 | 165 | 55 | 240 | 38 | 177 | 231 | 136 | 187 | 32 | 254 | |
| 102 | 236 | 199 | 75 | 92 | 33 | 227 | 6 | 205 | 143 | 19 | 106 | 48 | 93 | 70 | 149 | |
| 172 | 63 | 1 | 144 | 213 | 183 | 107 | 132 | 83 | 60 | 193 | 251 | 158 | 224 | 195 | 113 | |
| 30 | 185 | 225 | 114 | 23 | 155 | 65 | 247 | 173 | 218 | 122 | 78 | 10 | 127 | 8 | 54 | |
| 124 | 159 | 90 | 57 | 256 | 43 | 210 | 14 | 99 | 28 | 163 | 42 | 207 | 171 | 242 | 104 | |
| . | | | | | | | | | | | | | | | | |
| . | | | | | | | | | | | | | | | | |
| . | | | | | | | | | | | | | | | | |

Fig. 4

INK JET PRINTING METHOD AND PRINTER

CROSS-REFERENCE TO RELATED APPLICATIONS

This application is a Continuation of International Application No. PCT/EP2012/065934, filed on Aug. 15, 2012, and for which priority is claimed under 35 U.S.C. §120. PCT/EP2012/065934 claims priority under 35 U.S.C. §119(a) to Application No. 11178981.4, filed in Europe on Aug. 26, 2011. The entire contents of each of the above-identified applications are hereby incorporated by reference into the present application.

BACKGROUND OF THE INVENTION

1. Field of the Invention

The present invention relates to a method of printing a spit pattern for an inkjet printer comprising a print head having a plurality of nozzles wherein a receiving material is moved relatively to the print head and droplets of marking material are ejected from the nozzles onto the receiving material in order to form the spit pattern of dots of marking material on the receiving material.

2. Description of Background Art

In inkjet printing, nozzle failures may be caused by nozzle clogging, contamination of a plate, in which the nozzles are formed, events in which the nozzles are touched by the receiving material, and the like. Such nozzle failures are a serious threat to reliable ink jet printing and to print quality. Therefore, it is necessary to avoid a nozzle failure and to detect a nozzle failure as soon as possible after the moment in time of failure of the nozzle.

In a single pass print process, the print head and the receiving material are moved relative to one another in such a manner that each location on the receiving material is exposed to the nozzles of the print head only once. When the width of the print head is at least as large as the width of the receiving material, the receiving material may be moved past the print head in a uniform direction, or, conversely, the print head may be moved over the receiving material only once. When the print head does not cover the entire width of the receiving material, it is moved in a main scanning direction across the paper so as to print one or more lines, and the paper is then advanced in a sub-scanning direction, so that another swath of the image will be printed in the next pass of the print head. Such a single pass process is particularly vulnerable to nozzle failures because there are only limited possibilities to compensate nozzle failures by printing extra dots with other, still intact nozzles of the print head.

It is known that the risk of nozzle failures increases when a nozzle is inactive for a certain time, because the ink may dry-out in the nozzle. DE 10 2007 035 805 A1 proposes a multi-color ink jet printing method of the type specified in the opening paragraph, wherein the risk of nozzle failure is reduced by causing the nozzles to "spit" onto the receiving material from time to time even when the print data do not command a dot to be printed. In order to hide the extra dots from human perception as far as possible, the spit pattern is designed such that each extra dot will be superposed with a dot that is printed in another color, so that the extra dot is covered by a "regular" dot, or at least the extra dot does not significantly change the visual impression, because a dot, though in a different color, would have to be present at the dot location, anyway.

Another approach to improve reliability in ink jet printing involves an automatic nozzle failure detection, which permits to take measures for removing the nozzle failure before a larger number of defective images are printed. For example, nozzle failure may be detected by printing a test pattern and then inspecting the test pattern from time to time. However, this method implies a waste in paper and marking material, especially when the test is repeated in short intervals. Moreover, this method requires a sheet disposal trajectory in the paper pass of the printer, so that the sheets carrying the test pattern may be disposed.

Another method of nozzle failure detection involves inspecting the image that has been printed in accordance with the print data. This is advantageous, since a nozzle failure can be detected immediately, and the running print process may be stopped, if necessary. However, depending on the nature of the print data, it may be difficult to detect nozzle failures, and when a nozzle failure occurs at a nozzle which is not currently used for printing, the failure cannot be detected before the nozzle is used again.

U.S. Pat. No 7,393,077 B2 discloses a method of nozzle failure detection wherein, in a first step, only specific dots that shall be used for nozzle failure detection are printed on the receiving material, these dots are then inspected for the purpose of nozzle failure detection, and then the inspected area of the image is moved past the print head in a second pass so as to print the rest of the image in accordance with the print data. Consequently, this method requires a multi-pass print process. It is further observed in this document that the dots for nozzle failure detection do not have to form part of the image to be printed in accordance with the print data but should in any case be located in a low visibility area of the image, especially an area in which the spatial frequency of the image to be printed is within a certain range.

U.S. Application Publication No. 2010/0091053 A1 describes a spit pattern, which is included in the print data, wherein a location of a dot to be ejected according to the spit pattern is determined by means of a dither matrix of entries arranged in rows and columns, each entry comprising a natural number. The spit pattern is thus constructed independently of any user selected image to be printed, while paying careful attention to the characteristics of the human visual system. The spit pattern is constructed according to a bi-level bitmap, which is directly derived from a dither matrix by means of a threshold value. An entry of the dither matrix having a value lower than or equal to the threshold value corresponds to an entry in the bi-level bitmap having a value of one. An entry of the dither matrix having a value higher than the threshold value corresponds to an entry in the bi-level bitmap having a zero value. The dither matrix may be a white noise matrix, a random periodic matrix or a blue noise matrix. A dither matrix is normally used for printing an image, but may also be used for printing a spit pattern.

SUMMARY OF THE INVENTION

To characterize a spit pattern, the term dot distance is introduced. A dot distance is defined as a positive finite distance on the receiving material between two dots of marking material of the spit pattern ejected by the same nozzle.

To characterize a dither matrix, the term on-bit distance is introduced. An on-bit distance is defined as a positive finite distance between two entries in a column of a dither matrix, which both have a value that is lower than or equal to a selected threshold value while entries in between the two entries have a value that is higher than the selected threshold value. An alternative equivalent definition of on-bit distance is a positive finite Euclidean distance between two entries having a value of one in a column of a bi-level bitmap derived from a dither matrix and a selected threshold value, while values of entries in-between the two entries are zero.

For convenience, the two entries in the first and second definition will also be called on-bit entries.

The dot distance of a first dot ejected by a nozzle and a second dot ejected by the same nozzle is measured in units of dots ejected between the first dot and the second dot plus including one of the first dot and second dot and excluding the other of the first dot and the second dot. The on-bit distance between a first entry in a column of the dither matrix having an appropriate value and a second entry in the same column of the dither matrix having also an appropriate value is measured as the absolute difference between the row number of the first entry and the row number of the second entry.

Due to the fact that the locations of the dots of the spit pattern correspond to the positions defined by the row and column numbers of the entries of the dither matrix having a value of one, no additional unit conversion is necessary, if measuring the dot distance and the on-bit distance in the way as defined here-above.

Hereinafter, the dot distance as a numeric value, without units, may be interpreted as a desired on-bit distance in a final bitmap corresponding to a spit pattern to be printed. In other words, when a number of rows in a matrix or bitmap is adapted to be in accordance with the dot distance, it is meant that the number of rows is approximately equal to the numeric value of the dot distance.

For each nozzle, the dot distance of two dots intended to be printed by the nozzle on the receiving material corresponds to the on-bit distance in a dither matrix column that corresponds to the nozzle. Thus, there is a one-to-one correspondence of the dot distance of dots in a spit pattern and the on-bit distance of entries in the dither matrix. The term dot distance will be used in the context of a spit pattern, the on-bit distance will be used in the context of a dither matrix or a bi-level bitmap derived from the dither matrix. The numeric value of the dot distance will also be used in the context of a dither matrix or a bi-level bitmap derived from the dither matrix.

A dither matrix has different on-bit distances in a column in case of a plurality of on-bit entries in the column. A dither matrix has no on-bit distance in case of no on-bit entries. In case of just one on-bit entry in a column of a dither matrix, the on-bit distance may be defined as the number of rows of the dither matrix. The corresponding dot distance in the spit pattern may be defined accordingly. When each column of the dither matrix is intended to be printed by a different nozzle of the print head of the inkjet printer, the dot distances in a column of dots of the spit pattern printed on the receiving material according of the matrix correspond to the on-bit distances of neighboring on-bits entries in the corresponding column of the matrix.

A spit pattern needs a small enough dot distance for a nozzle to avoid clogging. On the other hand, a spit pattern needs a large enough dot distance for each nozzle to become imperceptible. A spit pattern is imperceptible if the printed spit pattern is not noticed by a majority of human observers under normal viewing conditions. Especially for high-velocity printers or usage of a marking material with a long dry time, a very large dot distance is allowable without extra risks for clogging or any other failure of the nozzles. Also, the larger a dot distance of a spit pattern, the less perceptible the printed spit pattern becomes.

Therefore, a small dither matrix, for example 256 by 256 pixels, is not suitable to use as a spit pattern when a large dot distance such as 2560 is desired. Larger dither matrices may be constructed, but need a lot of memory and cost a lot of processing time. Using a dither matrix as such for printing a spit pattern is also not desirable, even if it is large enough, because a dither matrix may have different on-bit entries with different on-bit distances in a column of the matrix or may have no on-bit entries in a column of the matrix. A nozzle intended to print such a latter column would never spit. Therefore, a pattern according to a dither matrix as such is not suitable as a spit pattern in which for each nozzle a single dot distance for the dots printed by the nozzle is desired.

It is an object of the present invention to print a spit pattern for preventing a nozzle from failing or detecting failure of a nozzle. This object is achieved by a method of printing a spit pattern for an inkjet printer comprising a print head having a plurality of nozzles, wherein a receiving material is moved relatively to the print head and droplets of marking material are ejected from the nozzles onto the receiving material in order to form the spit pattern of dots of marking material on the receiving material, wherein the method comprises the steps of:

a. selecting a dot distance between the dots of the spit pattern to be ejected by a nozzle, the dot distance being expressed in a number of dots;
b. selecting at least a sub-matrix of a dither matrix of entries arranged in rows and columns, each entry comprising a positive natural number, wherein the number of rows of the sub-matrix is less than or equal to the numeric value of the dot distance;
c. determining a threshold value based on the selected dot distance and on the dither matrix;
d. constructing a bi-level bitmap of the same size as the sub-matrix, each entry of the bi-level bitmap having a row number and a column number and having a value of zero or one dependent on the threshold value and the value of the corresponding entry in the sub-matrix;
e. splitting each column of the bi-level bitmap, which has more than one entry having a value of one, into a number of columns such that each column of the number of columns comprises exactly one entry having a value of one;
f. removing each column of the bi-level bitmap, which has no entry having a value of one;
g. extracting the row number and column number of each entry of the bi-level bitmap having a value of one;
h. adapting the row number of each extracted entry in accordance with the dot distance; and
i. printing the spit pattern by ejecting droplets of marking material forming the dots on locations on the receiving material according to the column number and adapted row number of each extracted entry.

The present invention is based on selecting a desired dot distance and an appropriate sub-matrix of a dither matrix. The dot distance also determines an on-bit distance to be established after adaptation of the dither matrix and the corresponding bi-level bitmap according to the further steps of the method according to the present invention. The number of rows of the sub-matrix is less than or equal to the numeric value of the dot distance. The number of rows may be equal to a divisor of the numeric value of the dot distance or may be equal to the numeric value of the dot distance. The sub-matrix may be selected equal to the whole dither matrix. The sub-matrix may be a part of the dither matrix, e.g. a number of consecutive rows of the dither matrix. This is advantageous when the number of rows of the dither matrix is larger than the dot distance. The number of consecutive rows may be a divisor of the numeric value of the dot distance or may be equal to the numeric value of the dot distance.

The present invention is also based on adapting the bi-level bitmap in a first direction and in a second direction in order to generate a spit pattern, which has a size in the first direction that is equal to the numeric value of the dot distance. A first step of the adaptation in the second direction is splitting a column of the bi-level bitmap with more than one on-bit entry in a same number of columns. A second step of the adaptation in the second direction is removing each column with no on-bit entry. By doing so, each column comprises exactly one on-bit entry. The adaptation in the first direction may be done by adapting the row number of each extracted entry in order to let a possible maximum row number of the extracted entries correspond to the on-bit distance. The maximum row number of the extracted entries may even be equal to the on-bit distance, which corresponds to the selected dot distance.

By applying the method according to the present invention, an array of extracted entries is created from the original dither matrix, which may be represented in a final bi-level bitmap. The size of the final bi-level bitmap is such that the length of each column is in accordance with the selected dot distance. Moreover, each column in the final bi-level bitmap contains only one on-bit entry. By doing so, the distribution of the extracted entries according to their row numbers and column numbers is comparable with the characteristic distribution of values lower than or equal to the threshold value in the sub-matrix. Therefore the advantages of printing an image according to the sub-matrix are maintained in printing of the spit pattern according to the extracted entries, i.e. the spit pattern becomes imperceptible. By printing dots according to the extracted entries, the selected dot distance of a nozzle, which prints one column of the spit pattern, is achieved. The row number and column number of each extracted entry are used to eject a droplet on the corresponding location of the spit pattern on the receiving material in order to form a dot of marking material on that location.

Hereinafter, a characteristic of a matrix or bitmap may be compared with the selected dot distance. Such a comparison has to be interpreted as a comparison of a characteristic of the matrix or bitmap with the numeric value of the selected dot distance.

According to an embodiment of the present invention, the method comprises the step of repeating the printing of the spit pattern in two perpendicular directions on the receiving material. A first direction of repetition is a direction in which the receiving material is relatively moving along the print head. A second direction of repetition is a direction perpendicular to the first direction. The printing of the spit pattern may be repeated in the first direction until the receiving material has completely passed the print head. The printing of the spit pattern may be repeated in the second direction until the whole size of the receiving material in the second direction is covered. Usually the printing of the spit pattern is combined with printing an image on the receiving material. The printing of the spit pattern may be repeated in the first direction until the image has been completely printed. The printing of the spit pattern may be repeated in the second direction until the size of the receiving material in the second direction comprising the image is covered. In this way, the area on the receiving material on which the image is printed is also covered by the dots of the repeated spit patterns. This is advantageous, since according to the extracted entries, the dot distance between the dots in a column of the repeated spit patterns in the first direction is equal to the selected dot distance.

According to an embodiment, the step of adapting the row number of each extracted entry comprises multiplying the row number with a factor larger than or equal to one. The factor may be derivable from the number of rows of the sub-matrix and the selected dot distance. Moreover, the factor may be equal to the dot distance divided by the number of rows of the sub-matrix. According to an alternative embodiment, the factor may be equal to the dot distance divided by the maximum row number of the extracted entries.

According to an embodiment of the present invention based on any of the previous embodiments, the inkjet printer is able to print in a plurality of N colors, wherein the selected dot distance is 1/N-th part of a desired dot distance for one color, and the method comprises the step of N times repeating the spit pattern in a first direction of relative movement of the receiving material and in another second direction creating a large spit pattern, wherein consecutive dots in each column of the large spit pattern in the first direction are intended to be printed in a different color, and dots in neighboring columns in the spit pattern and each repeated spit pattern in the second direction are intended to be printed in a different color. This is advantageous, since color artifacts in the repeated spit patterns are avoided.

According to an embodiment based on the previous embodiment, the inkjet printer is able to print in another color besides the plurality of N colors, and the method comprises the step of applying the steps of the method of the previous embodiment for a spit pattern of the other color with the same dot distance, and merging the spit pattern of the other color with the large spit pattern of the plurality of N colors by merging the extracted entries for the large spit pattern of the plurality of N colors and the extracted entries for the spit pattern of the other color. The merging may be with an offset in the first direction, which offset may be different from 1/N-th part of the dot distance. The offset may be equal to zero. For example, this embodiment may be applied for a plurality of colors with yellow amongst others, the method comprises the step of repeating the steps of the method for each color except yellow delivering a spit pattern for each remaining color with the selected dot distance according to the previous embodiment, determining a spit pattern for the color yellow with the same dot distance, merging the extracted entries corresponding to the spit pattern for the color yellow with the extracted entries corresponding to the spit patterns of the remaining colors by an offset and printing dots according to the merged extracted entries. This is advantageous, since due to the low visibility of the color yellow, this method will result in perceptually better distributed dots according to the extracted entries for the spit pattern of the remaining colors.

The present invention also relates to an inkjet printer comprising a print head having a plurality of nozzles, wherein a receiving material is moved relatively to the print head and droplets of marking material are ejected from the nozzles onto the receiving material in order to form a spit pattern of dots on the receiving material, wherein a dot of the spit pattern is formed on a location on the receiving material, which location is determined by the method according to the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 4-5 show a part of the dither matrix used for the method according to FIGS. 3A-3B;

DETAILED DESCRIPTION OF THE PREFERRED EMBODIMENTS

Figure 1A:
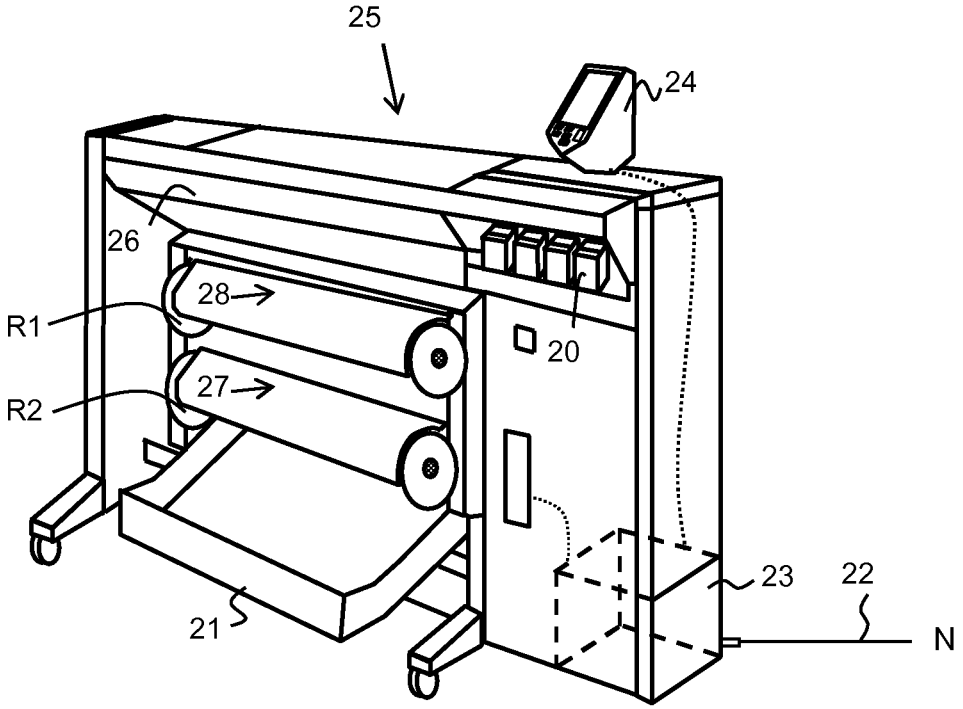
FIG. 1A is a schematic view of an image forming apparatus suitable for executing the method according to the present invention.
Figure 1B:
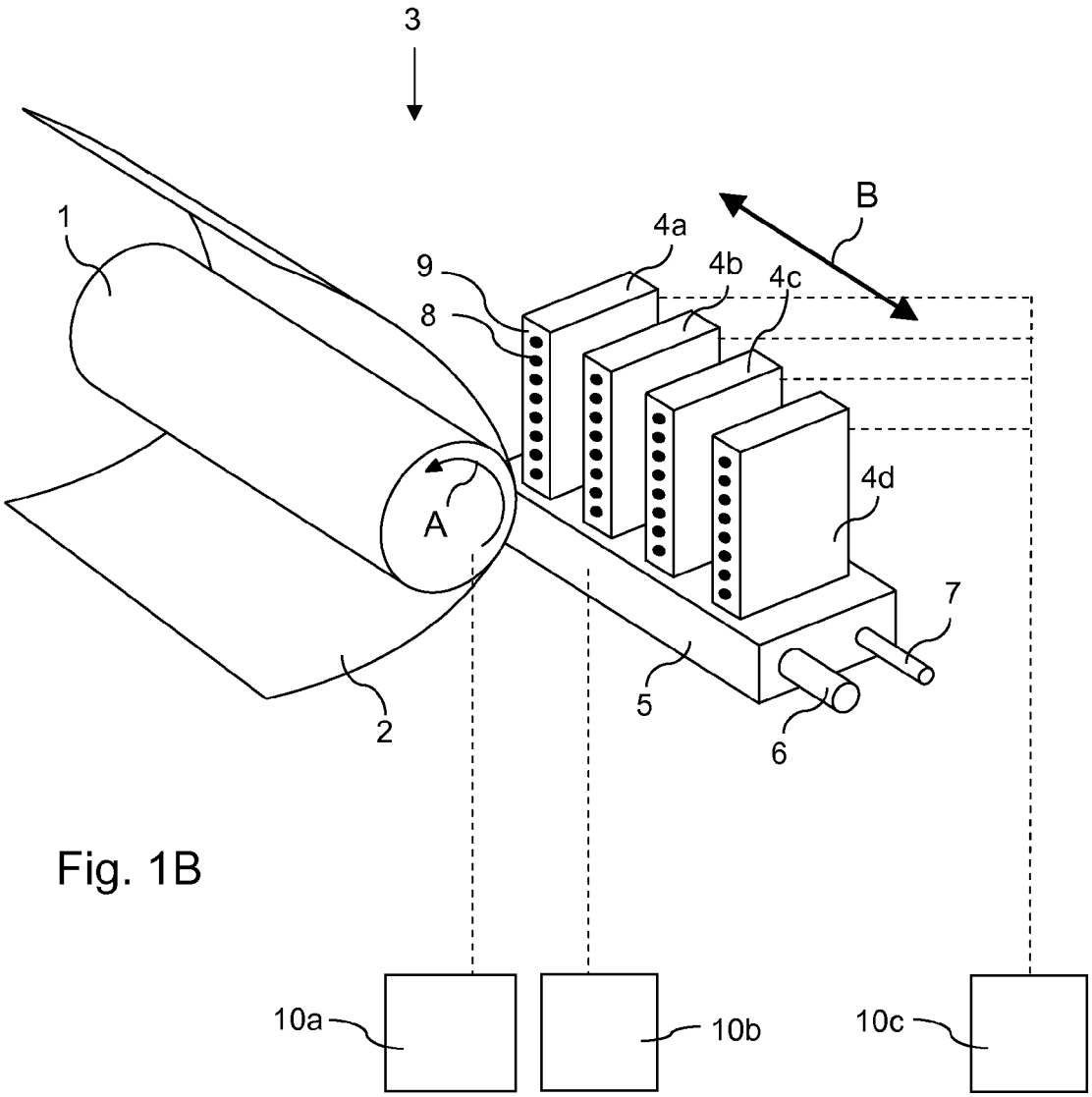
FIG. 1B is a schematic view of an ink jet printing assembly suitable for executing the method according to the present invention.

FIG. 1A shows an image forming apparatus 25, wherein printing is achieved using a wide format inkjet printer. The wide-format image forming apparatus 25 comprises a housing 26, wherein the printing assembly, for example the ink jet printing assembly shown in FIG. 1B, is placed. The image forming apparatus 25 also comprises a storage device for storing receiving material 27, 28, a delivery station to collect the receiving material 27, 28 after printing and a storage device for marking material 20. In FIG. 1A, the delivery station is embodied as a delivery tray 21. Optionally, the delivery station may comprise a processor configured to process the receiving material 27, 28 after printing, e.g. a folder or a puncher. The wide-format image forming apparatus 25 furthermore comprises A device configured to receive print jobs and optionally a device configured to manipulate print jobs. These devices may include a user interface unit 24 and/or a control unit 23, for example a computer.

Images are printed on a receiving material, for example paper, supplied by a roll 27, 28. The roll 28 is supported on the roll support R1, while the roll 27 is supported on the roll support R2. Alternatively, cut sheet receiving materials may be used instead of rolls 27, 28 of receiving material. Printed sheets of the receiving material, cut off from the roll 27, 28, are deposited in the delivery tray 21.

Each one of the marking materials for use in the printing assembly are stored in four containers 20 arranged in fluid connection with the respective print heads for supplying marking material to said print heads.

The local user interface unit 24 is integrated to the print engine and may comprise a display unit and a control panel. Alternatively, the control panel may be integrated in the display unit, for example in the form of a touch-screen control panel. The local user interface unit 24 is connected to a control unit 23 placed inside the printing apparatus 25. The control unit 23, for example a computer, comprises a processor adapted to issue commands to the print engine, for example for controlling the print process. The image forming apparatus 25 may optionally be connected to a network N. The connection to the network N is diagrammatically shown in the form of a cable 22, but nevertheless, the connection could be wireless. The image forming apparatus 25 may receive printing jobs via the network. Further, optionally, the controller of the printer may be provided with a USB port, so printing jobs may be sent to the printer via this USB port.

FIG. 1B shows an ink jet printing assembly 3. The ink jet printing assembly 3 comprises a support for supporting a receiving material 2. The support is shown in FIG. 1B as a platen 1, but alternatively, the support may be a flat surface. The platen 1, as depicted in FIG. 1B, is a rotatable drum, which is rotatable about its axis as indicated by arrow A. The support may be optionally provided with suction holes for holding the receiving material in a fixed position with respect to the support. The ink jet printing assembly 3 comprises print heads 4*a*-4*d*, mounted on a scanning print carriage 5. The scanning print carriage 5 is guided by suitable guides 6, 7 to move in reciprocation in the main scanning direction B. Each print head 4*a*, 4*b*, 4*c*, 4*d* comprises an orifice surface 9, which orifice surface 9 is provided with at least one orifice 8. The print heads 4*a*-4*d* are configured to eject droplets of marking material onto the receiving material 2. The platen 1, the carriage 5 and the print heads 4*a*-4*d* are controlled by suitable controls 10*a*, 10*b* and 10*c*, respectively.

The receiving material 2 may be a medium in web or in sheet form and may be composed of, e.g. paper, cardboard, label stock, coated paper, plastic or textile. Alternatively, the receiving material 2 may also be an intermediate member, endless or not. Examples of endless members, which may be moved cyclically, are a belt or a drum. The receiving material 2 is moved in the sub-scanning direction A by the platen 1 along four print heads 4*a*-4*d* provided with a fluid marking material.

A scanning print carriage 5 carries the four print heads 4*a*-4*d* and may be moved in reciprocation in the main scanning direction B parallel to the platen 1, such as to enable scanning of the receiving material 2 in the main scanning direction B. Only four print heads 4*a*-4*d* are depicted for demonstrating the present invention. In practice an arbitrary number of print heads may be employed. In any case, at least one print head 4*a*, 4*b*, 4*c*, 4*d* per color of marking material is placed on the scanning print carriage 5. For example, for a black-and-white printer, at least one print head 4*a*, 4*b*, 4*c*, 4*d*, usually containing black marking material is present. Alternatively, a black-and-white printer may comprise a white marking material, which is to be applied on a black image-receiving material 2. For a full-color printer, containing multiple colors, at least one print head 4*a*, 4*b*, 4*c*, 4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*, 4*b*, 4*c*, 4*d* containing black marking material may be larger than any of the print heads 4*a*-4*d*, containing a differently colored marking material.

The carriage 5 is guided by guides 6, 7. These guides 6, 7 may be rods as depicted in FIG. 1B. The rods may be driven by suitable drives (not shown). Alternatively, the carriage 5 may be guided by other guides, such as an arm being able to move the carriage 5. Another alternative is to move the receiving material 2 in the main scanning direction B.

Each print head 4*a*, 4*b*, 4*c*, 4*d* comprises an orifice surface 9 having at least one orifice 8, in fluid communication with a pressure chamber containing fluid marking material provided in the print head 4*a*, 4*b*, 4*c*, 4*d*. On the orifice surface 9, a number of orifices 8 is arranged in a single linear array parallel to the sub-scanning direction A. Eight orifices 8 per print head 4*a*, 4*b*, 4*c*, 4*d* are depicted in FIG. 1B, however, obviously in a practical embodiment, several hundreds of orifices 8 may be provided per print head 4*a*, 4*b*, 4*c*, 4*d*, optionally arranged in multiple arrays. As depicted in FIG. 1B, the respective print heads 4*a*-4*d* are placed parallel to each other such that corresponding orifices 8 of the respective print heads 4*a*-4*d* are positioned in-line in the main scanning direction B. This means that a line of image dots in the main scanning direction B may be formed by selectively activating up to four orifices 8, each of them being part of a different print head 4*a*, 4*b*, 4*c*, 4*d*. This parallel positioning of the print heads 4*a*-4*d* with corresponding in-line placement of the orifices 8 is advantageous to increase productivity and/or improve print quality. Alternatively, multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction. The image dots are formed by ejecting droplets of marking material from the orifices 8.

Upon ejection of the marking material, some marking material may be spilled and stay on the orifice surface 9 of the print head 4*a*, 4*b*, 4*c*, 4*d*. The ink present on the orifice surface 9 may negatively influence the ejection of droplets and the placement of these droplets on the receiving material 2. Therefore, it may be advantageous to remove excess ink from the orifice surface 9. The excess ink may be removed, for example, by wiping with a wiper and/or by application of a suitable anti-wetting property of the surface, e.g. provided by a coating.

Figure 2:
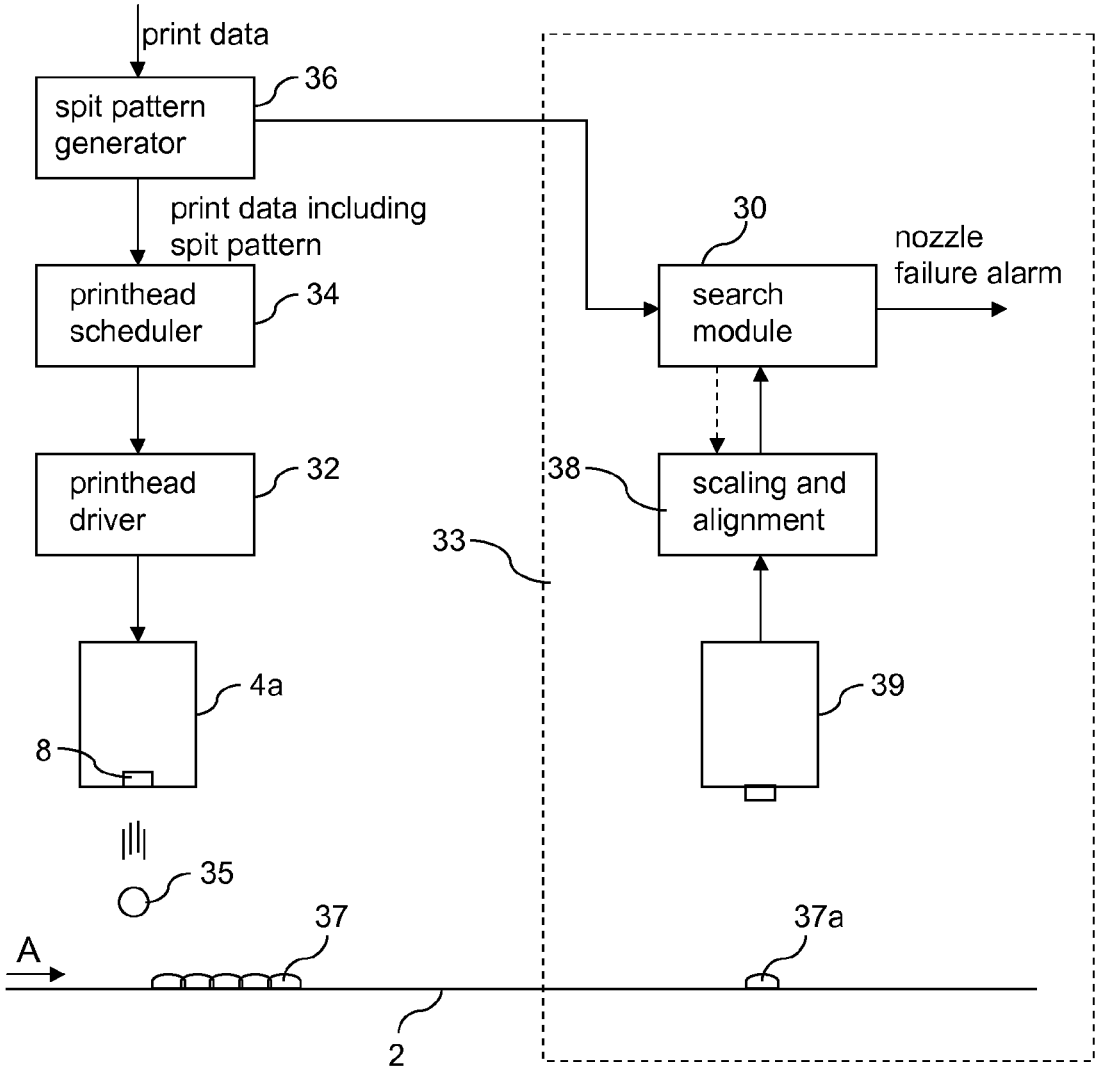
FIG. 2 is a schematic view of components of an inkjet printing assembly for executing the method according to the present invention.

As shown in FIG. 2, the receiving material 2, e.g. a sheet of paper, is moved with a constant speed in the direction of the arrow A by means of a transport mechanism that has not been shown. The print head 4*a* having a plurality of nozzles 8 is disposed above the path of the receiving material 2 and extends over the entire width of the receiving material (in the direction normal to the plane of the drawing in FIG. 2). The print head 4*a* is shown in FIG. 2, but without any limitations any of the other print head 4*b*, 4*c*, 4*d* may have been selected to elucidate this embodiment by means of FIG. 2. As is generally known in the art, the nozzles 8 have actuators configured to cause the nozzles to eject ink droplets 35 onto the receiving material 2 so as to print an image composed of dots 37 in accordance with print data supplied into the print head. The nozzles 8 are arranged in arrays of one or more lines across the width of the receiving material in a certain raster, which defines the print resolution, so that, within this raster, a dot 37 may be formed in any widthwise location on the receiving material. The locations of the dots 37 on the receiving material in the medium transport direction A are determined by the timings with which the individual nozzles are fired when the receiving material 2 moves past the print head. In case of a color printer, besides the print head 4*a*, the other print heads 4*b*, 4*c*, 4*d* will include a suitable array of nozzles 8 for other colors.

In an alternative embodiment, an optional part 33 for detecting a dot of a spit pattern is part of the image forming apparatus. The optional part 33 comprises a scanner 39 which is disposed downstream of the print head 4*a* in the transport direction A and may be formed by a single-line (monochromatic) CCD-based or CMOS-based camera that also extends over the entire width of the receiving material 2. When the receiving material 2 moves past the scanner 39, the expected location of an ejected dot according to the spit pattern is scanned, so that in the presence or absence of a dot according to the spit pattern on the location may be verified. In general, when a dot should have been printed in an expected location but cannot be detected with the scanner 39, this indicates that the corresponding nozzle 8 has failed.

The resolution of the scanner 39 may be different from the resolution of the print head 4*a*. This is why the image recorded by the scanner 39 is sent to a scaling and alignment unit 38 where the resolution of the scanner 39 is matched with the resolution of the print head. The scaling and alignment unit 38 serves for correcting any possible misalignment between the print head and the scanner.

The scanned image that has been processed in the scaling and alignment unit 38 is forwarded to a search module 30, which also receives the spit pattern generated by the spit pattern generator 36. The search module 30 searches those areas in the scanned image where a dot 37*a* should be present according to the spit pattern. When the dot 37*a* according to the spit pattern is actually found, it is concluded that the nozzle 8 that has printed this dot is still functioning. On the other hand, when no dot 37*a* according to the spit pattern is found in the search area, it is concluded that the corresponding nozzle has failed, and a nozzle failure alarm is sent to a main control unit of the printer, so that the print process may be stopped or measures may be taken for removing or camouflaging the nozzle failure.

In the shown example, the search module 30 searches only for the dots 37*a* that form the spit pattern. In a modified embodiment, the search module 30 may also receive the data from the print head scheduler 34 to verify whether the regular dots 37 corresponding to the print data before including the spit pattern have actually been printed. However, when the image to be printed contains solid areas in black (or any other color), where the dots 37 are directly adjacent to another and even partly overlap, the nozzle failure may create only a very small gap, which is difficult to detect with sufficient reliability. Moreover, even when such a gap is detected, it is difficult to decide which of the nozzles 8 is responsible for this gap, because even the scaling and alignment unit 38 will only be capable of correcting alignment errors with a certain accuracy.

Print data that specify the image to be printed are supplied to a print head driver 32, which causes the individual nozzles 8 of the print head to fire at appropriate timings. By way of example, it may be assumed that the nozzles 8 or their actuators are capable of firing synchronously with a certain frequency, so that a pixel line of dots 37 is formed on the receiving material 2 in each cycle. However, other printing strategies may be applied.

In the example shown, the print data are first supplied to a spit pattern generator 36. This spit pattern generator determines a pattern of dots 37*a* that shall be printed on the receiving material 2 in order to assure that each of the nozzles 8 of the print head will be activated from time to time so as to limit the interval in which the nozzle has been inactive or to detect a failure. This interval is selected such that the ink is prevented from drying out in the nozzle and causing a nozzle failure. The spit pattern is included in the print data. The print data including the spit pattern are supplied to a print head scheduler 34, which specifies for each operating cycle of the print head 4*a* which of the nozzles 8 has to be actuated. The print head scheduler 34 will then send corresponding instructions to the print head driver 32. The print head scheduler 34 sends the information, on which nozzle 8 will fire or has fired at which time, to the spit pattern generator 36. Instruction signals are sent from the print head scheduler 34 to the print head driver 32, so that the image that is actually printed with the print head 4*a* consists of an image specified by the print data including the spit pattern.

Since it is the main purpose of the spit pattern to assure that none of the nozzles 8 remains inactive for an excessively long period of time, regardless of the contents of the print data, the spit pattern is designed to let each of the nozzles 8 spit once in a predetermined time. The predetermined time has been established during experiments and in combination with the velocity of the receiving material along the print head of the image forming apparatus, a dot distance for a nozzle on the receiving material is established. This dot distance determines a frequency distance in pixels on the receiving material which reaches out from a pixel to be printed according to the spit pattern by a nozzle to a next pixel to be printed according to the spit pattern by the same nozzle. The spit pattern is intended to be printed according to a matrix of which each column represents pixels to be printed by a different nozzle.

On the other hand, the matrix has to be designed in such a way that the dots intended to be printed according to the spit pattern, become imperceptible. Matrices are known from the background art, for example a blue noise matrix or a green noise matrix, which have been optimized to have an optimal graininess by reducing visibly disturbing frequencies. For example, blue noise dither matrices for halftoning methods have been found to produce images with pleasing visual characteristics. "Blue noise" refers to an unstructured pattern with negligible low frequency noise components that produce a fine, visually appealing arrangements of dots. However, such a matrix is suitable for printing of a digital image, for example a full color picture, and not suitable for printing an imperceptible spit pattern of scattered dots with a same frequency distance for each nozzle, because the columns of the blue noise matrix have different frequency distances.

The method according to the present invention takes a dither matrix as a starting point, preferably a blue noise matrix. From such a dither matrix, at least a sub-matrix is selected. The whole dither matrix may be selected as a sub-matrix. From the sub-matrix, a bi-level bitmap is created, which is to be used for printing a spit pattern. The bi-level bitmap is adapted and entries are extracted from the adapted bi-level bitmap. The row numbers of the extracted entries are adapted. The adapted extracted entries form a final bi-level bitmap. The successive dots intended to be printed according to a spit pattern derived from the final bi-level bitmap by a same nozzle are spaced according to the selected dot distance.

Moreover, the property of the original dither matrix, that disturbing frequencies of dots printed according to the original matrix are reduced, also holds for dots printed according to the final bi-level bitmap. Each column of the final bi-level bitmap comprises exactly one entry, which corresponds to a dot to be printed for spitting. The creation of the final bi-level bitmap is such that the number of rows of the final bi-level bitmap is equal to the selected dot distance.

It is noted that, in general, a bitmap may be a two-dimensional representation of entries corresponding to dots of the spit pattern. The present invention also comprises such a kind of bitmap that is represented as a one-dimensional array in which the spit pattern is determined by the value in each entry of the array and the index of this entry in the array. The value in an entry may represent a row number, while the index of the entry may represent a column number.

Figure 3A:
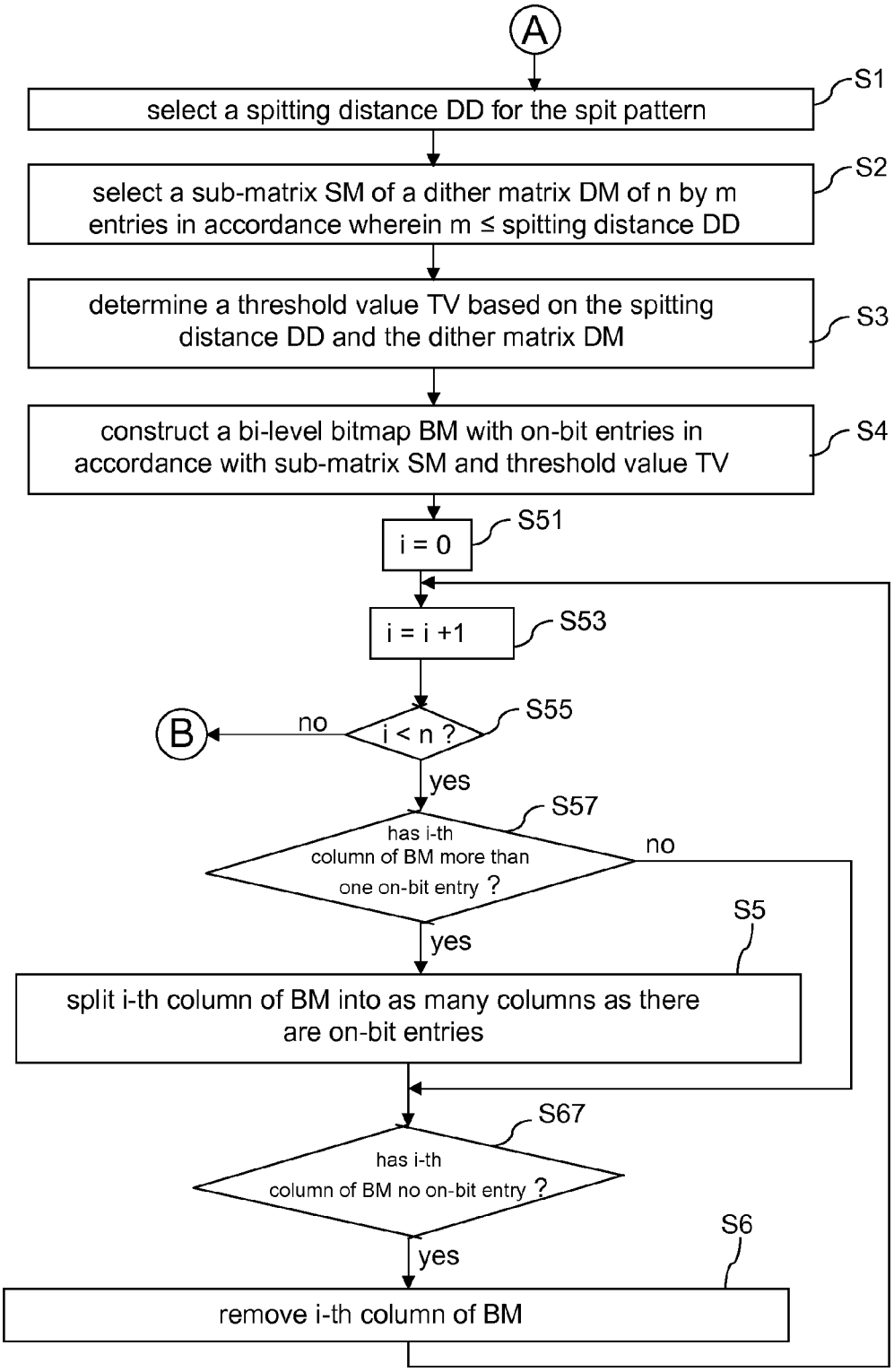
FIGS. 3A-3B are flow diagrams of an embodiment of the method according to the present invention.
Figure 3B:
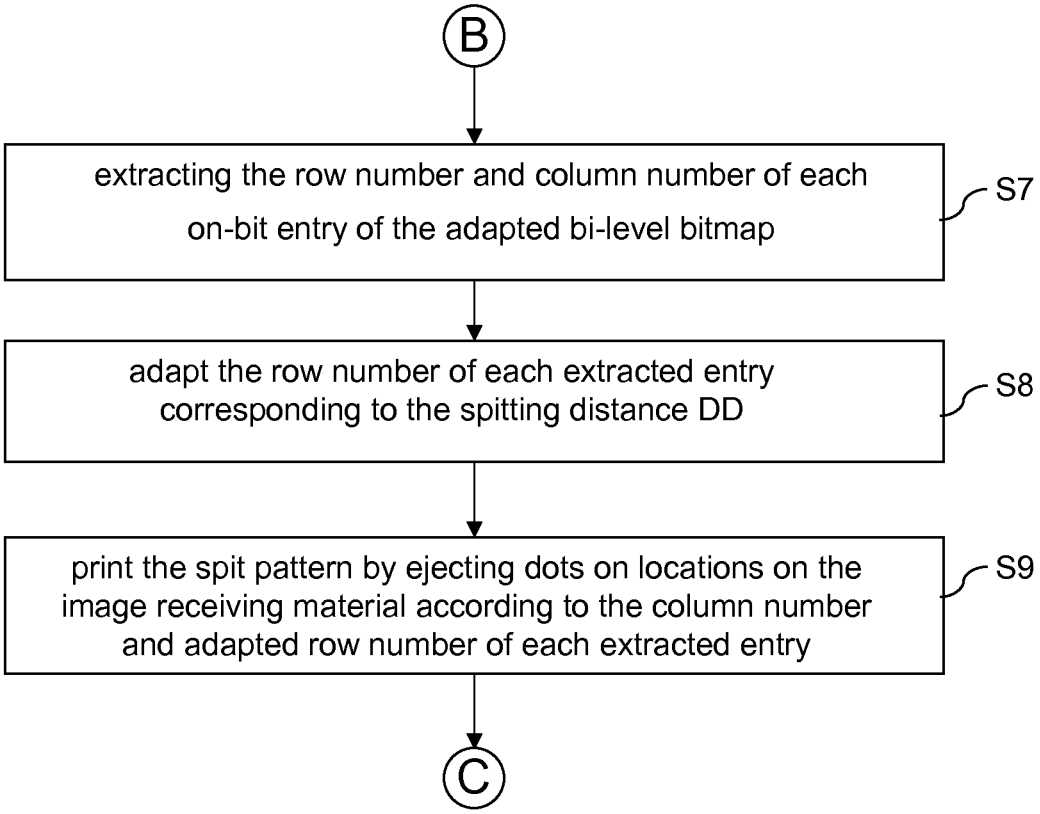

According to an embodiment of the method according to the present invention, the following steps are taken to transform a dither matrix into a final bi-level bitmap suitable for printing a spit pattern. The steps S1-S9 are shown in FIGS. 3A-3B. The steps S1-S9 are further elucidated by means of FIGS. 4-8.

The method shown in FIGS. 3A-3B starts at starting point A, which leads to a first step S1. According to the first step S1, a dot distance DD is selected. For example, the selected dot distance DD may be equal to 2560. The dot distance may be optimized for the speed of the printing apparatus, the used print head, the used marking material, etc.

Hereinafter, the dot distance DD as an absolute value, without units, may be interpreted as a desired on-bit distance in a final bi-level bitmap corresponding to a spit pattern to be printed. The dot distance DD as an absolute value may also be referred to as the numeric value of the dot distance DD.

According to a second step S2, a dither matrix DM is selected, which is a rectangular matrix of n columns and m rows having n×m entries. An aspect ratio of the dither matrix DM is defined as the ratio n/m. Each entry of the dither matrix DM has an entry value ranging from 1 to N. The dither matrix may be selected in such a way that the number of rows m of the dither matrix is less than or equal to the numeric value of the selected dot distance DD, for example the number of rows m is a divisor of the numeric value of the dot distance DD. As an example, N is selected to be equal to 256 and m is selected to be equal to 256, which is a divisor of the numeric value of the dot distance DD which equals 2560. A first set of 26×16 values of the n×m dither matrix DM is shown in FIG. 4. It is noted that in this embodiment, the whole dither matrix DM is selected as sub-matrix SM according to the invented method.

According to a third step S3, a threshold value TV is determined based on the selected dot distance DD and the selected dither matrix DM. The threshold value TV is determined in such a way that the aspect ratio of a final bi-level bitmap approaches the aspect ratio of the original dither matrix DM.

In a first case, the number of rows m is smaller than or equal to the dot distance DD. Then, the threshold value TV may be determined by a formula $DD*N/m^2$. In the example in which DD=2560, N=256 and m=256, the threshold value TV becomes $2560*256/256^2=10$.

For visibility and explanatory reasons, each column shown in FIG. 4 contains at least one entry with a value that is lower than or equal to the threshold value TV. This kind of display of FIG. 4 is not meant as limiting for the method of the present invention.

In a second case, the number of rows m of the original dither matrix is larger than the selected dot distance DD. The sub-matrix may be selected to be the first DD rows of the original dither matrix. Then, the threshold value TV may be determined by a formula N/DD.

Figure 13A:
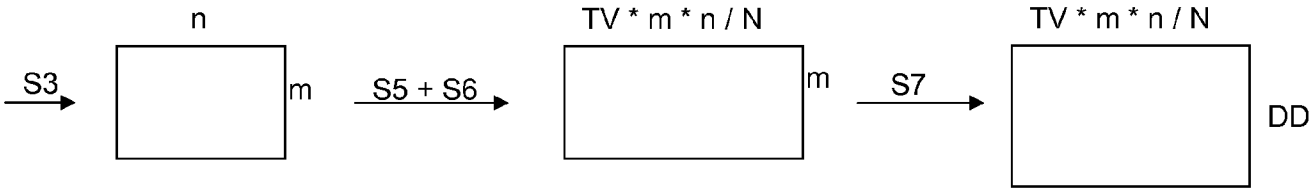
FIG. 13A shows the size of the bi-level bitmap during the steps of the method according to FIGS. 3A-3B.

The derivation of the formula in the first case is explained further on, on the basis of FIG. 13A. The derivation of the formula in the second case is explained further on, on the basis of FIG. 13B.

In an alternative embodiment, the threshold value TV calculated according to the first case is rounded to a positive integer value.

When the rounded threshold value TV is greater than or equal to one, the further method steps of the first case are used.

When the rounded threshold value TV is equal to zero, the threshold value TV is again calculated according to the second case and the further method steps according to the second case are used. The threshold value TV, which is calculated again according to the second case, may be rounded before applying the further method steps according to the second case.

The steps S4-S8 are explained for the first case.

According to a fourth step S4, a bi-level bitmap BM is constructed with on-bit entries in accordance with the values of the entries of the dither matrix DM being equal to the sub-matrix SM. An entry of the dither matrix DM with a value lower than or equal to the threshold value, establishes an on-bit entry in the bi-level bitmap BM at the same row number and column number as in the dither matrix DM having a value of one. These on-bit entries are the entries on which the dots of the spit pattern will be based. An entry of the dither matrix DM with a value higher than the threshold value TV, establishes an entry in the bi-level bitmap BM at the same row number and column number as in the dither matrix DM having a value of zero. The number of columns of the bi-level bitmap BM is the same as the number of columns n of the dither matrix DM. The number of rows of the bi-level bitmap BM is the same as the number of rows m of the dither matrix DM.

Figure 5:
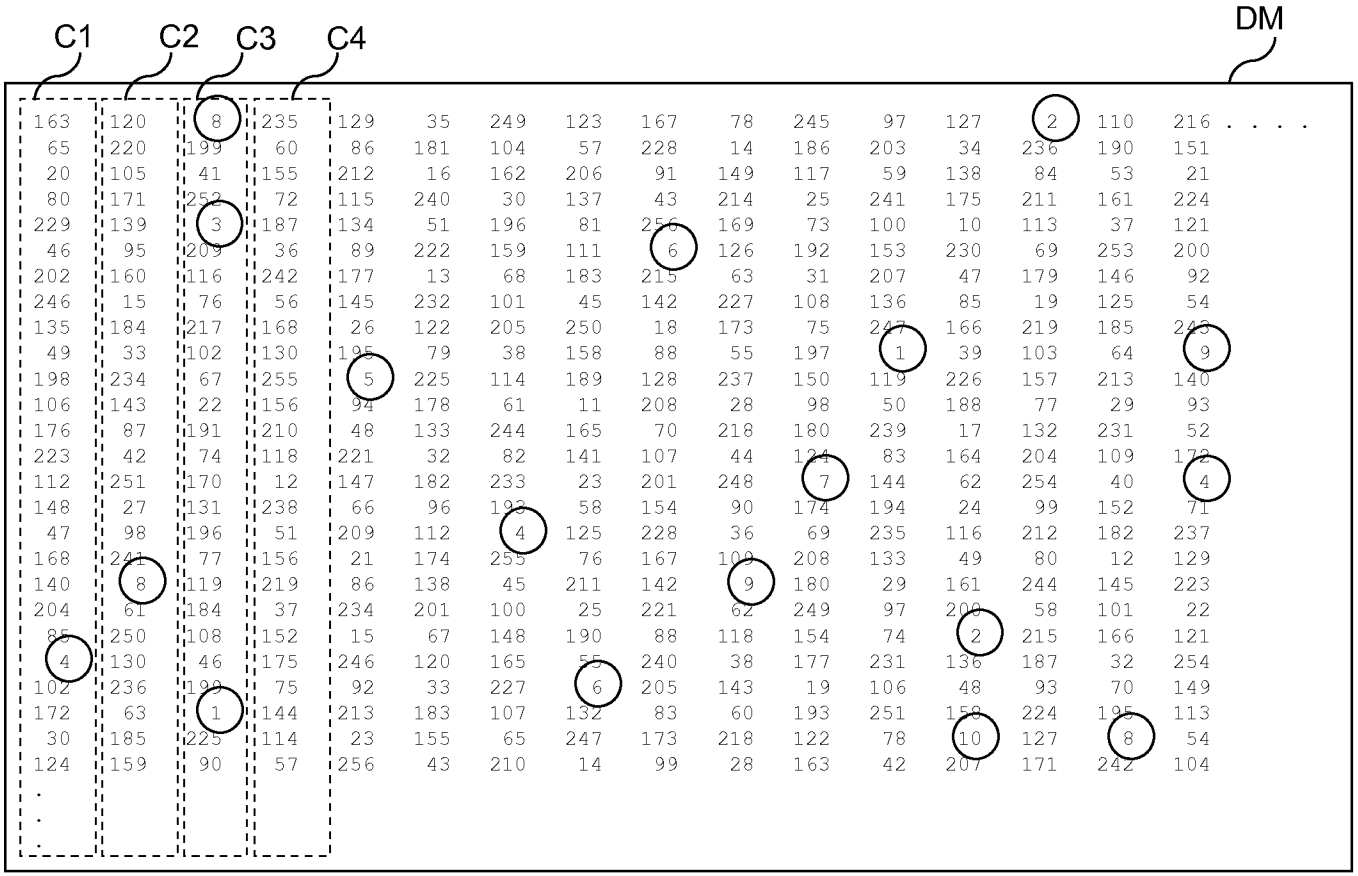

FIG. 5 shows the dither matrix DM again. The entries of the dither matrix DM having a value lower than the threshold value TV being 10 are marked by encircling those entries. Note that a column of the dither matrix DM may comprise zero, one or more encircled entries. A first column C1 comprises one marked entry. A second column C2 comprises one marked entry. A third column C3 comprises three marked entries. A fourth column C4 comprises zero marked entries.

Figure 6:
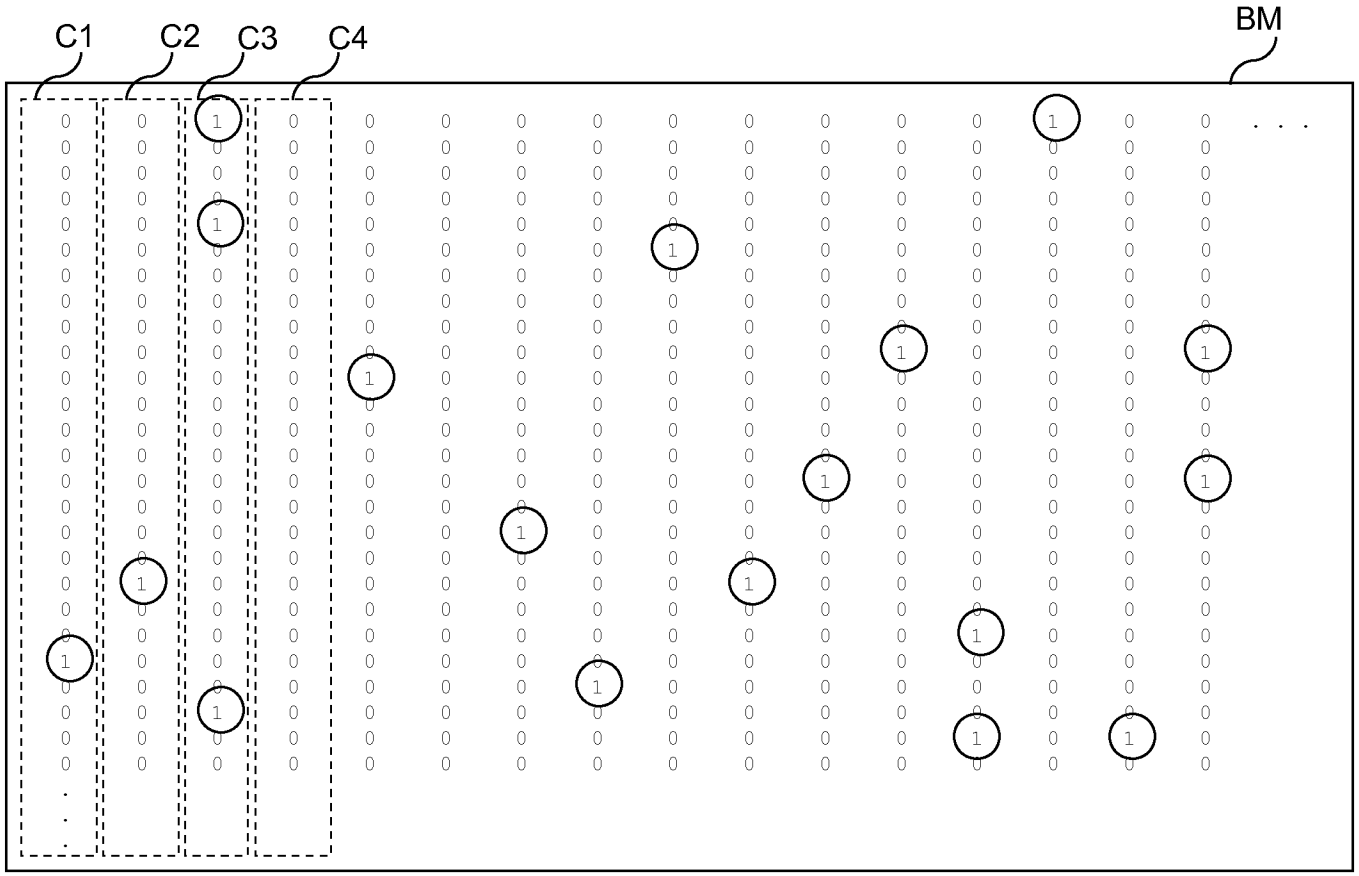
FIGS. 6-8 show a part of the bi-level bitmap used for the method according to FIGS. 3A-3B.

FIG. 6 shows the corresponding bi-level bitmap BM. The on-bit entries of the bi-level bitmap BM having a value of one are encircled. A first column C1 comprises one on-bit entry. A second column C2 comprises one on-bit entry. A third column C3 comprises three on-bit entries. A fourth column C4 comprises zero on-bit entries.

Figure 7:
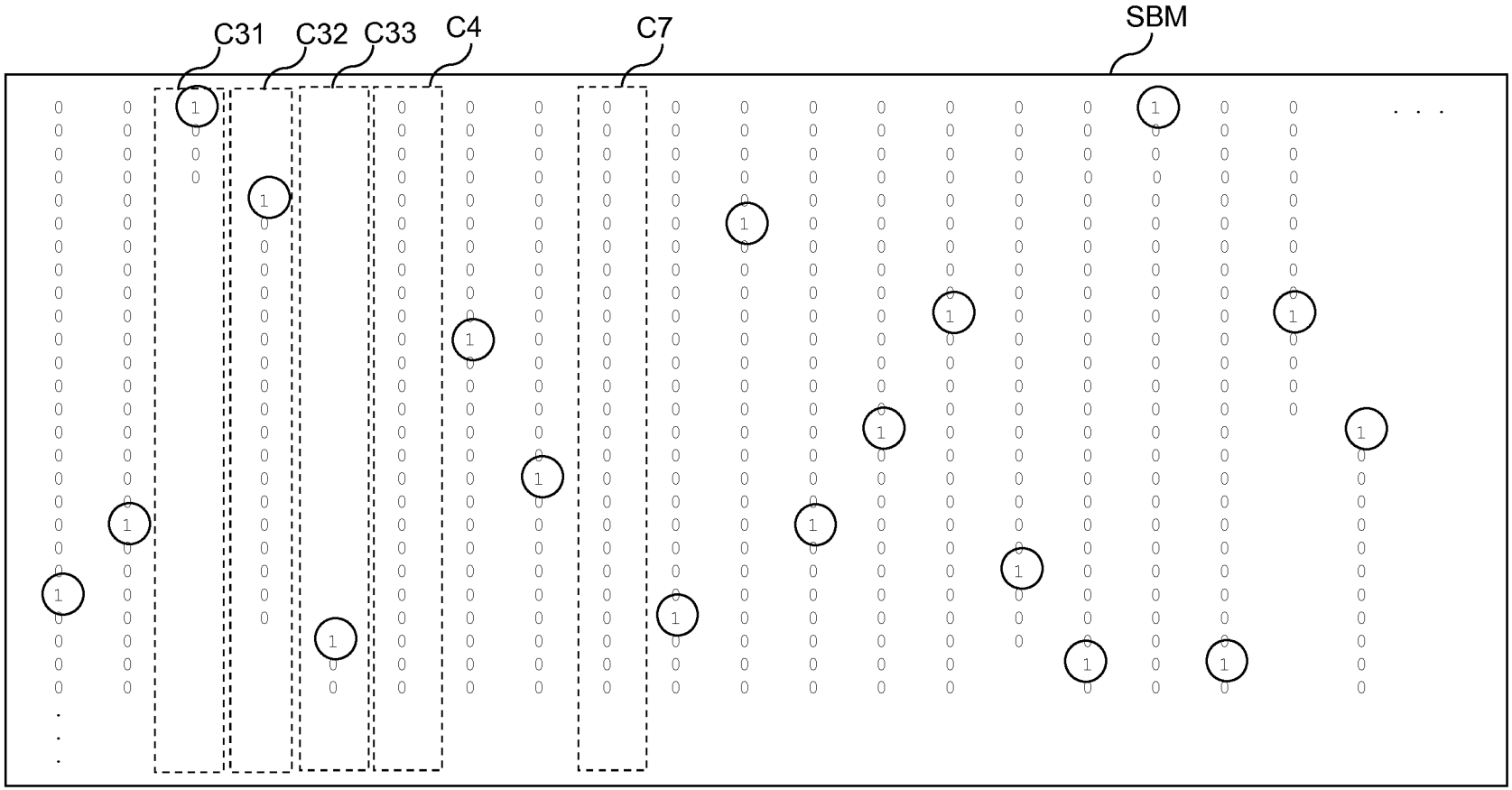

According to a fifth step S5 each column of the bi-level bitmap BM, which has more than one on-bit entry, is split into a number of new columns such that each new column comprises exactly one on-bit entry. The split bi-level bitmap SBM comprising new columns is shown in FIG. 7. A first new column C31 comprises one on-bit entry having row number 1. A second new column C32 comprises one on-bit entry having row number 5. A third new column C33 comprises one on-bit entry having row number 24. By doing so, every (new) column contains one on-bit entry or zero on-bit entries.

Figure 8:
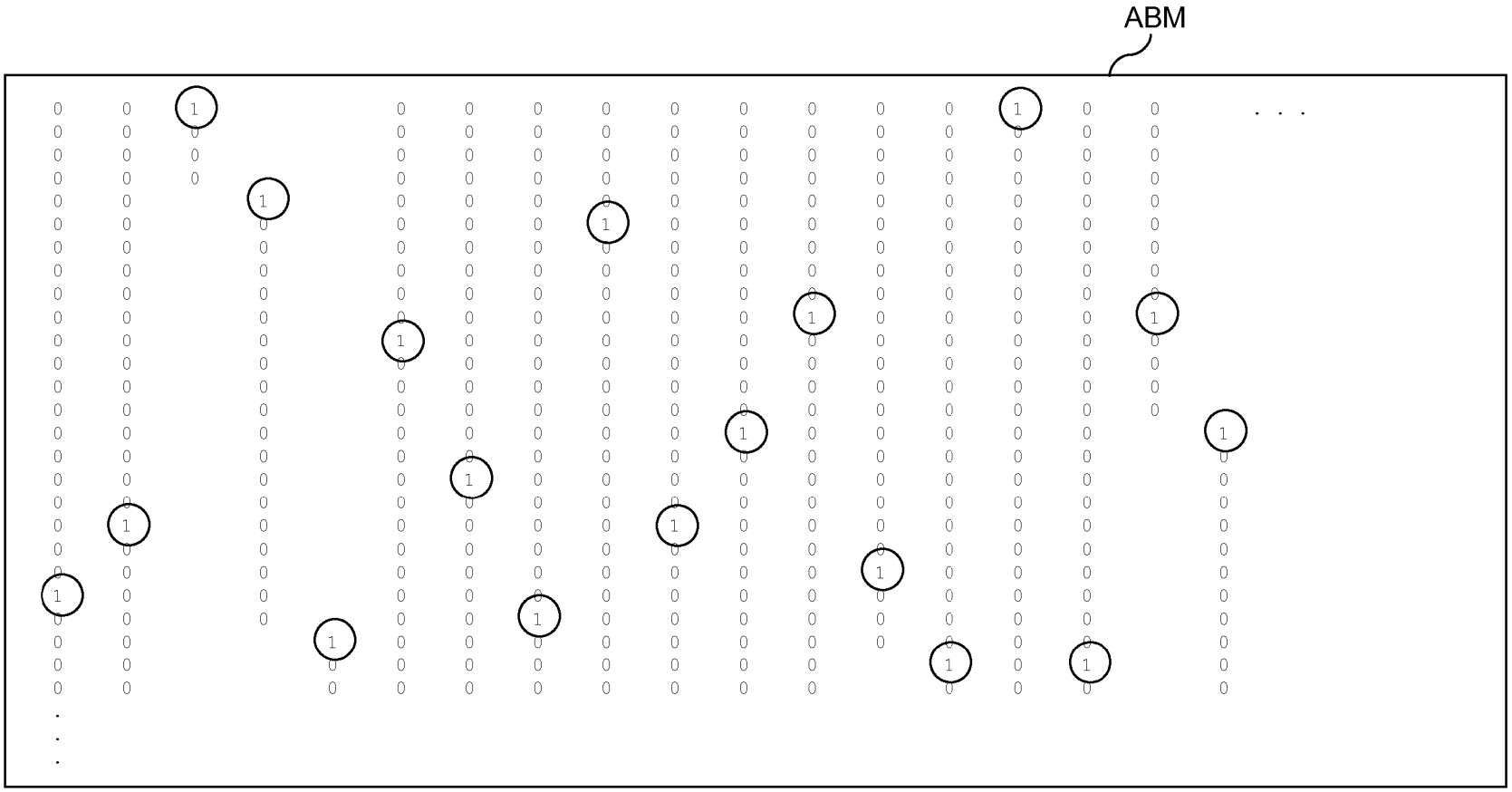

According to a sixth step S6, each column of the bi-level bitmap SBM, which has no on-bit entry, is removed. The original fourth column C4 and the original seventh column C7 do not comprise any on-bit entries and will be removed. The adapted split bi-level bitmap ABM is shown in FIG. 8. By doing so, each column of the adapted split bi-level bitmap ABM contains exactly one on-bit entry.

The number of entries in the original dither matrix DM having a value lower than or equal to the threshold value TV is equal to the number TV*m*n/N=10*256*n/256=10*n. Therefore the number of columns of the adapted split bi-level bitmap ABM is also equal to 10*n. In other words, the number of columns in the adapted split bi-level bitmap ABM comprises 10 times more columns than the original dither matrix DM.

When all columns have been investigated, the algorithm continues at marker point B in FIG. 3A, which corresponds with marker point B in FIG. 3B.

According to a seventh step S7, the row number and column number of each on-bit entry is extracted from the adapted split bi-level bitmap ABM. The extraction from the part of the adapted split bi-level bitmap ABM shown in FIG. 8 results in an array of pairs of a row number and a column number of on-bit entries comprising {(22,1), (19,2), (1,3), (5,4), (24,5), (11,6), (17,7), (23,8), (6,9), (19,10), (15,11), (10,12), (21,13), (25,14), (1,15), (25,16), (10,17), (15,18)}.

According to an eighth step S8, the row number of each extracted entry is adapted in order to correspond to the dot distance DD. This may be achieved by multiplying the row numbers of the extracted entries by a factor equaling DD/m=2560/256=10. For each extracted entry, the row number of the entry is multiplied with the same factor. If the number DD/m is not a natural number, the factor may be rounded up to the nearest natural number. The row number of the first extracted entry is equal to 22, resulting in the new row number 22×10=220. The maximum possible new row number is 10×m=10×256=2560, which is equal to the numeric value of the dot distance DD. The adaptation of the row numbers results in an array of pairs of a row number and a column number comprising {(220,1), (190,2), (10,3), (50,4), (240,5), (110,6), (170,7), (230,8), (60,9), (190,10), (150,11), (100,12), (210,13), (250,14), (10,15), (250,16), (100,17), (150,18), . . . }.

The resulting array may be visualized in a final bi-level bitmap with DD rows of entries having a zero value, except the entries in the array which have a value of one.

The number of columns of the final bi-level bitmap is equal to the number of columns of the adapted split bi-level bitmap ABM, i.e. TV*m*n/N=10*256*n/256=10*n.

The number of rows of the final bi-level bitmap is equal to the numeric value of the dot distance DD. The aspect ratio of the final bi-level bitmap is thus TV*m*n/(DD*N)=10*n/2560=n/256. This is equal to the aspect ratio of the original dither matrix being n/m=n/256. The distribution of on-bit entries in the final bi-level bitmap resembles, when scaled, the distribution of corresponding entries in the original dither matrix DM for threshold value TV equaling 10. The row numbers and the column numbers of the on-bit entries in the final bi-level bitmap are defining the spit pattern.

According to a ninth step S9, the spit pattern is printed by ejecting droplets of marking material forming the dots on locations on the receiving material according to the column number and adapted row number of each extracted entry. Each column of the final bi-level bitmap is intended to be printed by a different nozzle. The locations of the dots of the spit pattern on the receiving material are according to the positions defined by the column number and the adapted row number of the on-bit entries in the final bi-level bitmap.

After executing the ninth step S9, an end point C of the method is reached.

The steps S4-S9 are carried out for a dot distance DD, which numeric value is larger than or equal to the number of rows of the original dither matrix DM, mentioned before as the first case.

In the second case, the number of rows m of the original dither matrix DM is higher than the numeric value of the dot distance DD. The selected sub-matrix SM may be only the first DD rows of the dither matrix DM. The sub-matrix SM is used as input for the fourth step S4. In other words, the dither matrix DM is clipped for the first DD rows of entries. In this second case, the threshold value TV is determined by a formula N/DD. By defining the threshold value TV to be N/DD, the aspect ratio of the final bi-level bitmap also resembles the aspect ratio of the sub-matrix SM. Since the number of columns of the final bi-level bitmap is approximately equal to TV*DD*n/N and the number of rows equals DD, the aspect ratio equals TV*DD*n/(N*DD)=TV*n/N. Since the threshold value TV equals N/DD, the aspect ratio becomes TV*n/

N=(N/DD)*n/N=n/DD, which is the aspect ratio of the sub-matrix SM being the clipped original dither matrix DM.

The information of the final bi-level bitmap is combined with the pixel information of the image data in a convenient way. For example, an on-bit entry of the final bi-level bitmap is incorporated in the image data on the appropriate position, when on the appropriate location on the receiving material no dot according to the image data is intended to be printed. According to an alternative embodiment, the value of the on-bit entry is 'or-ed' with the value of the corresponding position in the image data. Other embodiments of combining the information of the image data and the final bi-level bitmap may be envisioned and do not limit the scope of the method according to the present invention.

Figure 9:
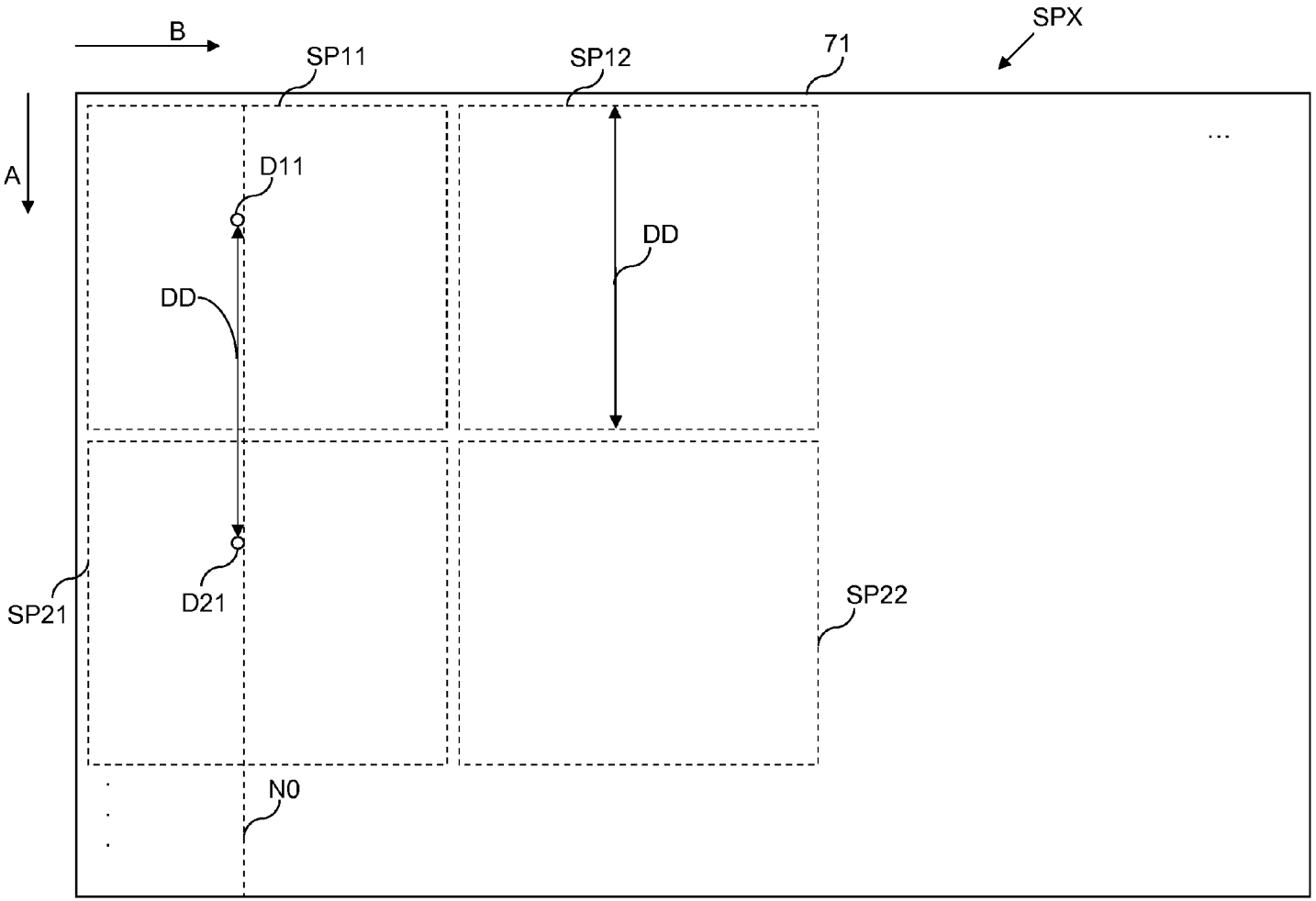
FIG. 9 shows an embodiment of the method with repeated spit patterns.

FIG. 9 shows an embodiment of the method, which comprises the step of repeating the printing of the spit pattern in two perpendicular directions A, B on a part 71 of the receiving material until an image to be printed is covered by the dots of the repeated printed spit patterns SP11, SP12, SP21, SP22. A first direction A is the direction in which the receiving material is moving relatively to the printing elements of the reproduction apparatus. The repeated spit pattern SP11, SP12, SP21, SP22 form a large spit pattern SPX. Note that the dot distance DD in each column of the large spit pattern SPX is also the dot distance DD of each column of each spit pattern SP11, SP12, SP21, SP22. For example, the distance between a first dot D11 in spit pattern SP11 and a second dot D21 in spit pattern SP21, both dots D11, D21 in a same column NO of the large spit pattern SPX, equals the dot distance DD. The dot distance DD is also equal to the number of dot rows in each spit pattern SP11, SP12, SP21, SP22.

Figure 10:
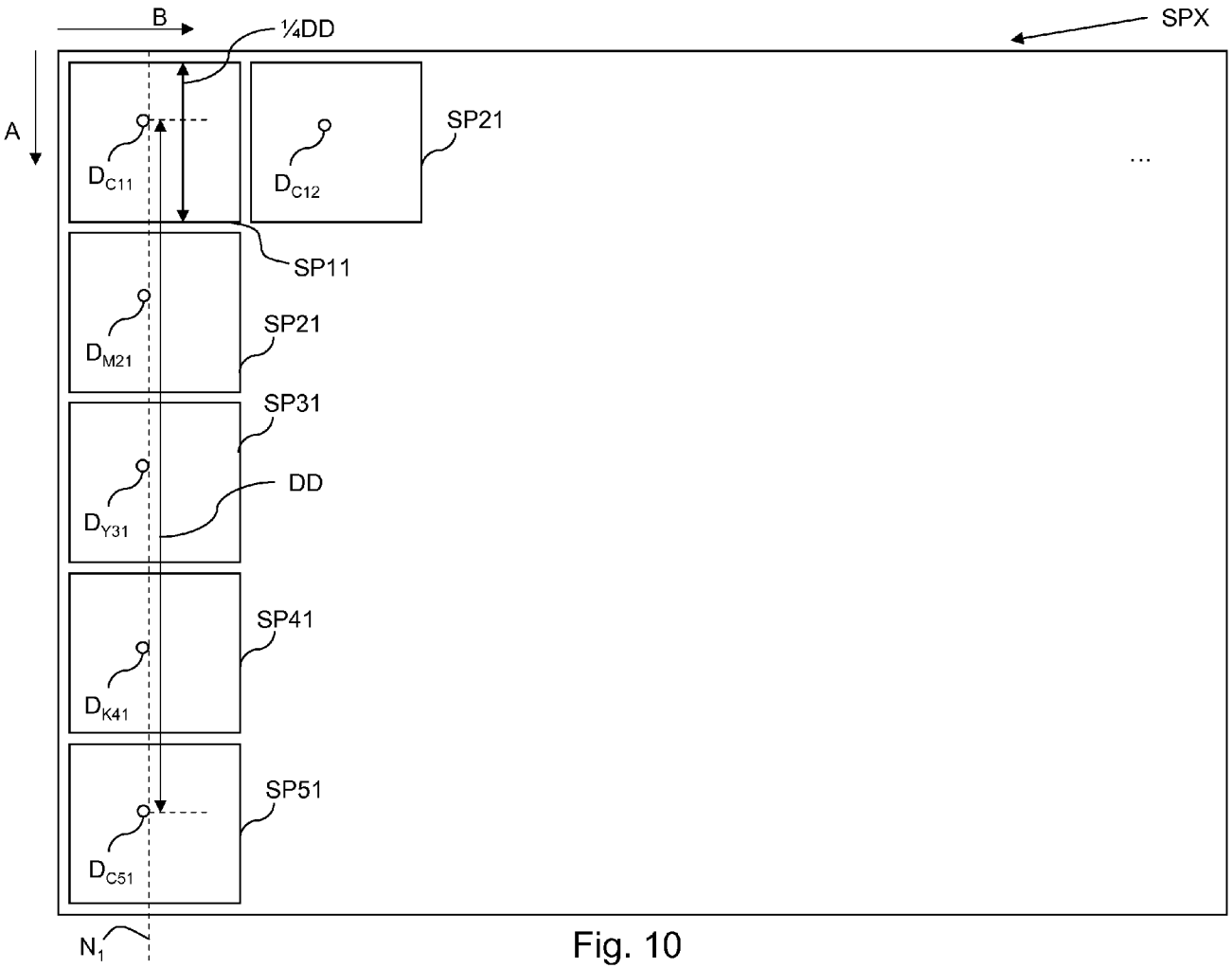
FIGS. 10-12 show embodiments of the method with repeated spit patterns in the case of a plurality of colors of the marking material.
Figure 11:
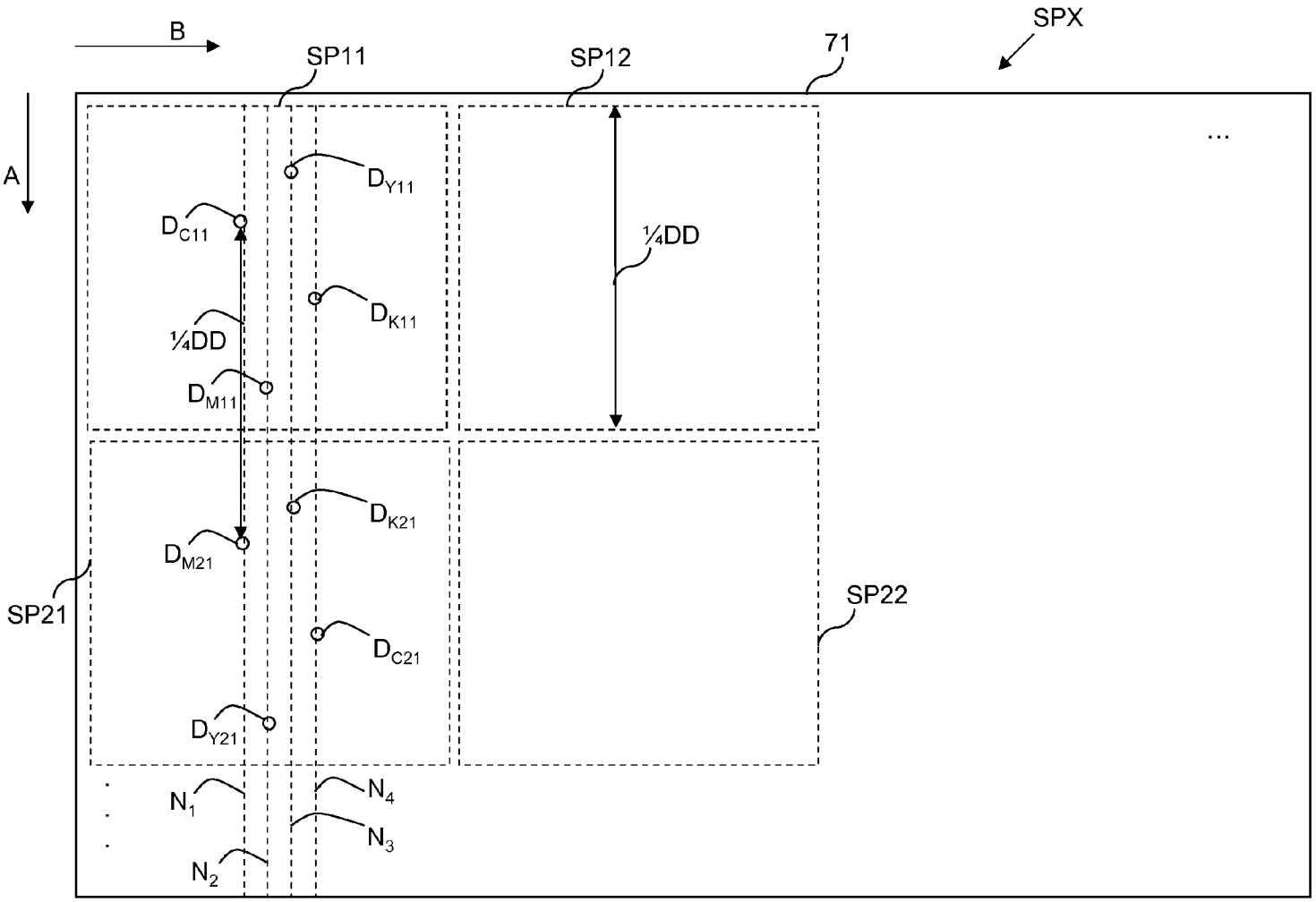

FIGS. 10-11 show another embodiment of the method, wherein the inkjet printer is able to print marking material in a number of colors C, M, Y, K. The dot distance DD of each nozzle for each color C, M, Y, K is equally selected. The spit pattern is repeated in two perpendicular directions A, B in order to cover the whole image area to be printed. Each spit pattern SP11, SP12, SP21, SP22 is formed by first dots DCij, by second dots DMij, by third dots DYij and fourth dots DKij, wherein i and j are natural numbers. The first dots DCij are intended to be printed by nozzles suitable to eject a cyan colored marking material. The second dots DMij are intended to be printed by nozzles suitable to eject a magenta colored marking material. The third dots DYij are intended to be printed by nozzles suitable to eject a yellow colored marking material. The fourth dost DKij are intended to be printed by nozzles suitable to eject a black colored marking material. For convenience reasons, FIG. 8A shows only the entries DC11, DM21, DY31, DK41, DC51, DC12 of a first column N1 present in a first spit pattern SP11, a second spit pattern SP21, a third spit pattern SP31, a fourth spit pattern SP41 and a fifth spit pattern SP51. However, each spit pattern SP11, SP21, SP31, SP41, SP51, SP12 comprises dots formed by nozzles of all colors C, M, Y, K as shown in FIG. 11.

FIG. 11 shows four neighboring columns N1, N2, N3, N4. In the first spit pattern SP11 the first column N1 comprises a first dot DC11, a second column N2 comprises a second dot DM11, a third column N3 comprises a third dot DY11 and a fourth column N4 comprises a fourth dot DK11. In the second spit pattern SP21, the first column N1 comprises a first dot DM21, the second column N2 comprises a second dot DY21, the third column N3 comprises a third dot DK21 and the fourth column N4 comprises a fourth dot DM21. Each number of four neighboring columns N1, N2, N3, N4 in each spit pattern SP11, SP21, SP12, SP22 comprise one entry per column to be printed with a different colored marking material. In each column N1, N2, N3, N4 of spit patterns SP11, SP21 positioned above each other, the colors of the dots DC11, DM21 are ordered according to a cyclic CMYK-sequence order, wherein the color for the first dot of the column is dependent on the column number.

The size of the final bi-level bitmap is selected to be equal to the size of a final bi-level bitmap for one color according to the present invention divided by the number of colors. In the case of four colors C, M, Y, K the size of the final bi-level bitmap is equal to a quarter of the size of a final bi-level bitmap in the case of one color. By doing so, the dot distance DD of each nozzle for each color C, M, Y, K equals four times the number of rows of the final bi-level bitmap. For example, the first dot DC11 of the first spit pattern SP11 is intended to be printed by the same nozzle as a first dot DC51 of the fifth spit pattern SP51 (see FIG. 8A) beneath spit patterns SP11, SP21, SP31, SP41 on the left side of the large spit pattern SPX.

This way of spreading the marking material of different colors in the large spit pattern SPX is advantageous since possible color artifacts in the large spit pattern SPX are avoided.

Figure 12:
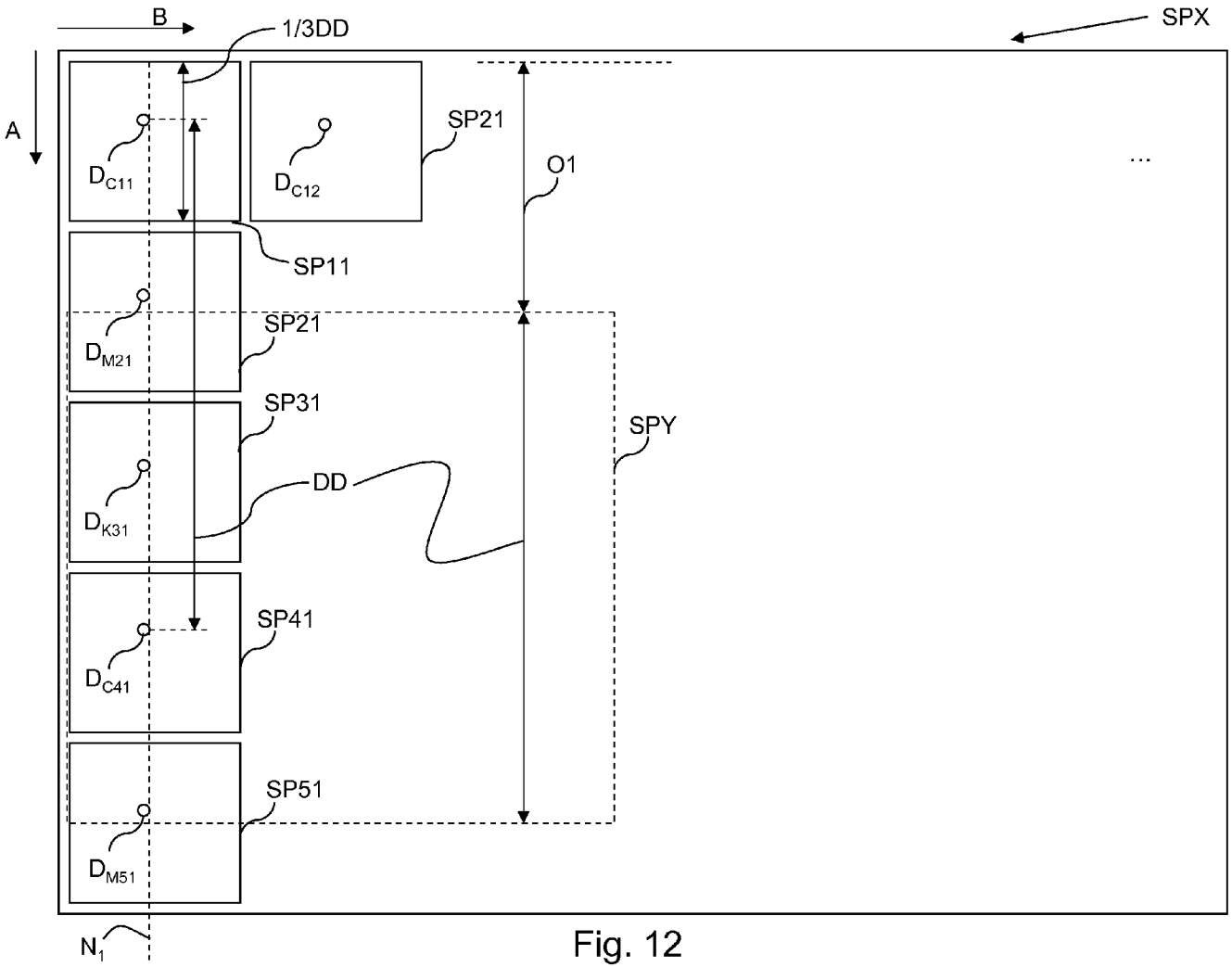

FIG. 12 shows another embodiment based on the previous embodiment, wherein the inkjet printer is able to print with yellow, cyan, magenta and black marking material. The spit patterns SP11, SP12, SP13, SP14, SP15, SP21 are determined for three colors only, i.e. the colors cyan, magenta and black, as described in the previous embodiment mutatis mutandis for three colors. The determined spit patterns SP11, SP12, SP13, SP14, SP15, SP21 each have a number of dot rows which equals one third of the dot distance DD and forms a large spit pattern SPX. Also an additional yellow spit pattern SPY with the same dot distance DD is determined for yellow only. The yellow spit pattern SPY is merged with the spit patterns SP11, SP12, SP13, SP14, SP15, SP21 of the other colors cyan, magenta and black. The merging may take place with an offset O1 in a first direction A in which the receiving material is able to move relatively. In order to achieve a smooth merge, the offset O1 may be different from ⅓ part of the dot distance DD. Also an offset O1 equal to zero may be applied. In this example, the offset O1 is equal to half the dot distance DD. The color yellow is selected for the additional spit pattern, due to the low visibility of the color yellow. When yellow or any other color with a low visibility, e.g. white, is selected, this method will result in perceptually better distributed dots according to the bi-level bitmaps for the remaining colors cyan, magenta, black, which have a higher visibility.

FIG. 13A shows the number of rows and columns of the bi-level bitmap during the steps S3-S7 of the method according to the first case. It is preferred to let the aspect ratio of the final bi-level bitmap after the seventh step S7 equal the aspect ratio of the bi-level bitmap constructed in the fourth step S4. This leads to the following equation:

$$n/m=TV*m*n/(N*DD)$$

which leads to a preferred threshold value TV equalling $N*DD/m^2$.

Figure 13B:
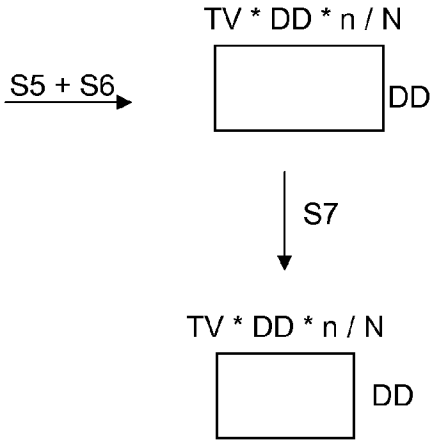
FIG. 13B shows the size of the bi-level bitmap during the steps of an alternative embodiment of the method according to the present invention.

FIG. 13B shows the number of rows and columns of the bi-level bitmap during the steps S3-S7 of the method according to the second case. It is preferred to let the aspect ratio of the final bi-level bitmap after the seventh step S7 equal the aspect ratio of the bi-level bitmap constructed in the fourth step S4. This leads to the following equation:

$$n/DD=TV*DD*n/(N*DD)$$

which leads to a preferred threshold value TV equalling N/DD.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of printing a spit pattern for an inkjet printer, the inkjet printer comprising a print head having a plurality of nozzles, wherein a receiving material is moved relatively to the print head and droplets of marking material are ejected from the nozzles onto the receiving material in order to form the spit pattern of dots of marking material on the receiving material, wherein the method comprises the steps of:

selecting a dot distance between the dots of the spit pattern to be ejected by a nozzle, the dot distance being expressed in a number of dots;

selecting at least a sub-matrix of a dither matrix of entries arranged in rows and columns, each entry comprising a positive natural number, wherein the number of rows of the sub-matrix is less than or equal to the numeric value of the dot distance;

determining a threshold value based on the selected dot distance and on the dither matrix;

constructing a bi-level bitmap of the same size as the sub-matrix, each entry of the bi-level bitmap having a row number and a column number and having a value of zero or one dependent on the threshold value and the value of the corresponding entry in the sub-matrix;

splitting each column of the bi-level bitmap, which has more than one entry having a value of one, into a number of columns such that each column of the number of columns comprises exactly one entry having a value of one;

removing each column of the bi-level bitmap, which has no entry having a value of one;

extracting the row number and column number of each entry of the bi-level bitmap having a value of one;

adapting the row number of each extracted entry in accordance with the dot distance; and printing the spit pattern by ejecting droplets of marking material forming the dots on locations on the receiving material according to the column number and adapted row number of each extracted entry.

2. The method according to claim 1, further comprising the step of repeating the printing of the spit pattern in two perpendicular directions on the receiving material.

3. The method according to claim 2, wherein the step of adapting the row number of each extracted entry comprises multiplying the row number with a factor larger than or equal to one.

4. The method according to claim 2, wherein the inkjet printer is able to print in a plurality of N colors, wherein the selected dot distance is 1/N-th part of a desired dot distance for one color, said method further comprising the step of N times repeating the spit pattern in a first direction of relative movement of the receiving material and in another second direction creating a large spit pattern, wherein consecutive dots in each column of the large spit pattern in the first direction are intended to be printed in a different color, and dots in neighboring columns in the spit pattern and each repeated spit pattern in the second direction are intended to be printed in a different color.

5. The method according to claim 4, wherein the inkjet printer is able to print in another color besides the plurality of N colors and the method further comprises, for a spit pattern of the other color with the same dot distance, the steps of:

selecting a dot distance between the dots of the spit pattern to be ejected by a nozzle, the dot distance being expressed in a number of dots;

selecting at least a sub-matrix of a dither matrix of entries arranged in rows and columns, each entry comprising a positive natural number, wherein the number of rows of the sub-matrix is less than or equal to the numeric value of the dot distance;

determining a threshold value based on the selected dot distance and on the dither matrix;

constructing a bi-level bitmap of the same size as the sub-matrix, each entry of the bi-level bitmap having a row number and a column number and having a value of zero or one dependent on the threshold value and the value of the corresponding entry in the sub-matrix;

splitting each column of the bi-level bitmap, which has more than one entry having a value of one, into a number of columns such that each column of the number of columns comprises exactly one entry having a value of one;

removing each column of the bi-level bitmap, which has no entry having a value of one;

extracting the row number and column number of each entry of the bi-level bitmap having a value of one;

adapting the row number of each extracted entry in accordance with the dot distance;

printing the spit pattern by ejecting droplets of marking material forming the dots on locations on the receiving material according to the column number and adapted row number of each extracted entry; and merging the spit pattern of the other color with the large spit pattern of the plurality of N colors by merging the extracted entries for the large spit pattern of the plurality of N colors and the extracted entries for the spit pattern of the other color.

6. An inkjet printer comprising a print head having a plurality of nozzles wherein a receiving material is moved relatively to the print head and droplets of marking material are ejected from the nozzles onto the receiving material, wherein the inkjet printer comprises:

a spit pattern generator for generating a spit pattern by performing the steps of the method of claim 2;

a print head scheduler for scheduling the spit pattern and print data to be ejected by the plurality of nozzles; and a print head driver for driving the print head according to instructions received from the print head scheduler in order to form dots of marking material on locations on the receiving material, which locations are determined according to the spit pattern and the print data.

7. The method according to claim 2, wherein the step of adapting the row number of each extracted entry comprises multiplying the row number with a factor larger than or equal to one.

8. The method according to claim 1, wherein the inkjet printer is able to print in a plurality of N colors, wherein the selected dot distance is 1/N-th part of a desired dot distance for one color, said method further comprising the step of N times repeating the spit pattern in a first direction of relative movement of the receiving material and in another second direction creating a large spit pattern, wherein consecutive dots in each column of the large spit pattern in the first direction are intended to be printed in a different color, and dots in neighboring columns in the spit pattern and each repeated spit pattern in the second direction are intended to be printed in a different color.

9. The method according to claim 8, wherein the inkjet printer is able to print in another color besides the plurality of N colors and the method further comprises, for a spit pattern of the other color with the same dot distance, the steps of:

selecting a dot distance between the dots of the spit pattern to be ejected by a nozzle, the dot distance being expressed in a number of dots;

selecting at least a sub-matrix of a dither matrix of entries arranged in rows and columns, each entry comprising a positive natural number, wherein the number of rows of the sub-matrix is less than or equal to the numeric value of the dot distance;

determining a threshold value based on the selected dot distance and on the dither matrix;

constructing a bi-level bitmap of the same size as the sub-matrix, each entry of the bi-level bitmap having a row number and a column number and having a value of zero or one dependent on the threshold value and the value of the corresponding entry in the sub-matrix;

splitting each column of the bi-level bitmap, which has more than one entry having a value of one, into a number of columns such that each column of the number of columns comprises exactly one entry having a value of one;

removing each column of the bi-level bitmap, which has no entry having a value of one;

extracting the row number and column number of each entry of the bi-level bitmap having a value of one;

adapting the row number of each extracted entry in accordance with the dot distance;

printing the spit pattern by ejecting droplets of marking material forming the dots on locations on the receiving material according to the column number and adapted row number of each extracted entry; and merging the spit pattern of the other color with the large spit pattern of the plurality of N colors by merging the extracted entries for the large spit pattern of the plurality of N colors and the extracted entries for the spit pattern of the other color.

10. An inkjet printer comprising a print head having a plurality of nozzles wherein a receiving material is moved relatively to the print head and droplets of marking material are ejected from the nozzles onto the receiving material, wherein the inkjet printer comprises:

a spit pattern generator for generating a spit pattern by performing the steps of the method of claim 1;

a print head scheduler for scheduling the spit pattern and print data to be ejected by the plurality of nozzles; and a print head driver for driving the print head according to instructions received from the print head scheduler in order to form dots of marking material on locations on the receiving material, which locations are determined according to the spit pattern and the print data.

* * * * *